US007744085B2

(12) United States Patent
Tsutsui et al.

(10) Patent No.: US 7,744,085 B2
(45) Date of Patent: Jun. 29, 2010

(54) IMAGE FORMING APPARATUS INCLUDING SHEET PROCESSING UNIT CAPABLE OF ALIGNING SHEETS

(75) Inventors: Kazuya Tsutsui, Tokyo (JP); Shingo Matsushita, Tokyo (JP); Tamaki Kaneko, Fujisawa (JP)

(73) Assignee: Ricoh Co., Ltd., Tokyo (JP)

( * ) Notice: Subject to any disclaimer, the term of this patent is extended or adjusted under 35 U.S.C. 154(b) by 144 days.

(21) Appl. No.: 11/521,519

(22) Filed: Sep. 15, 2006

(65) Prior Publication Data

US 2007/0057441 A1 Mar. 15, 2007

(30) Foreign Application Priority Data

Sep. 15, 2005 (JP) ..... 2005-268972
Aug. 10, 2006 (JP) ..... 2006-218853

(51) Int. Cl.
*B65H 31/36* (2006.01)

(52) U.S. Cl. ..... 271/221; 271/223; 270/58.12; 270/58.08

(58) Field of Classification Search ..... 271/221, 271/223; 270/58.12, 58.08
See application file for complete search history.

(56) References Cited

U.S. PATENT DOCUMENTS 5,098,074 A * 3/1992 Mandel et al. ..... 270/58.13
5,288,062 A * 2/1994 Rizzolo et al. ..... 270/58.12
5,289,251 A * 2/1994 Mandel et al. ..... 399/407
5,473,420 A * 12/1995 Rizzolo et al. ..... 399/107
6,120,020 A * 9/2000 Asao ..... 271/189
6,231,039 B1 * 5/2001 Chung ..... 270/58.01
6,305,681 B1 * 10/2001 Watanabe et al. ..... 270/58.08
6,352,253 B1 * 3/2002 Hayakawa et al. ..... 270/58.12
6,427,997 B1 * 8/2002 Hirota et al. ..... 270/58.12
6,666,444 B1 * 12/2003 Paoli ..... 270/58.11
6,871,851 B2 3/2005 Tamura et al.
7,014,183 B2 3/2006 Tamura et al.
7,021,616 B2 * 4/2006 Mizuta et al. ..... 270/58.11
7,192,020 B2 * 3/2007 Hayashi et al. ..... 270/58.11
7,215,922 B2 * 5/2007 Terao et al. ..... 399/405
7,264,237 B2 * 9/2007 Kato et al. ..... 270/58.12
7,354,035 B2 * 4/2008 Terao et al. ..... 270/58.11

(Continued)

FOREIGN PATENT DOCUMENTS

JP 02-182495 7/1990

(Continued)

*Primary Examiner*—Saúl J Rodríguez
*Assistant Examiner*—Luis Gonzalez
(74) *Attorney, Agent, or Firm*—Harness, Dickey & Pierce, P.L.C.

(57) ABSTRACT

An image forming apparatus may include an image forming mechanism configured to form an image and transfer the image on a sheet member, and/or a sheet processing unit. The sheet processing unit may include a sheet aligning unit, an ejection sheet tray configured to stack the sheet member, a sheet stopper configured to align the sheet member at a trailing edge thereof, a return mechanism configured to return the sheet member stacked on the ejection sheet tray to the sheet stopper, and/or a discharging mechanism configured to discharge the sheet member, aligned by the return mechanism, from the sheet stopper to the ejection sheet tray. The sheet aligning unit may include a stacking mechanism configured to stack the sheet member transferred into the sheet aligning unit and/or a sheet aligning mechanism configured to align the sheet member.

15 Claims, 22 Drawing Sheets

U.S. PATENT DOCUMENTS

| | | | | |
|---|---|---|---|---|
| 7,429,037 | B2 * | 9/2008 | Kawata et al. | 270/37 |
| 2005/0189706 | A1 | 9/2005 | Tamura et al. | |
| 2005/0277537 | A1 | 12/2005 | Matsushita | |
| 2006/0019811 | A1 * | 1/2006 | Ikeda et al. | 493/444 |
| 2006/0055100 | A1 | 3/2006 | Suzuki et al. | |

FOREIGN PATENT DOCUMENTS

| | | |
|---|---|---|
| JP | 02-276691 | 11/1990 |
| JP | 08-091686 | 4/1996 |
| JP | 08-318912 | 12/1996 |
| JP | 09-202517 | 8/1997 |
| JP | 10-109809 | 4/1998 |
| JP | 2000-063033 | 2/2000 |
| JP | 2003-335449 | 11/2003 |
| JP | 2005-194105 | 7/2005 |

* cited by examiner

IMAGE FORMING APPARATUS INCLUDING SHEET PROCESSING UNIT CAPABLE OF ALIGNING SHEETS

BACKGROUND

1. Field

Example embodiments generally relate to an image forming apparatus including a sheet processing unit, for example, to an image forming apparatus including a sheet processing unit capable of aligning a sheet.

2. Discussion of the Background

In general, a related-art image forming apparatus, for example, a copying machine, a printer, a facsimile machine, etc., employing an electrophotographic method may form and develop an electrostatic latent image with toner and transfer the developed image onto a recording sheet. Such a related-art image forming apparatus may store a plurality of recording sheets, transport them one by one to an image transfer area, and eject the image-transferred recording sheet. Thus, a plurality of recording sheets may be randomly or regularly ejected and stacked at a specific stacking place in a related-art image forming apparatus. As would be expected, the edges of the recording sheets are not aligned.

A related art image forming apparatus may include a sheet processing unit for performing jogging, stapling, and/or punching, relative to the output sheets. With such a sheet processing unit, the recording sheets stacked at the specific stacking place may be jogged, staples, and/or punched, depending on user instructions.

However, the functions of jogging, stapling, and/or punching may not be needed and may be used only on an as needed basis. In some cases, these functions may never be used at a user site. In such a case, the sheet processing unit itself is a relatively large and expensive unit that may be unnecessary.

FIG. 1 illustrates an example of a related-art mechanism to perform the jogging function, and illustrates a malfunction in the related-art image forming apparatus. As illustrated in FIG. 1, the sheet processing unit may include a sheet jogging tray 101 provided with a pusher paddle 102*a*, a sheet jogging plate 102*b*, and/or a loading surface 104. On the loading surface 104 of the sheet jogging tray 101, a recording sheet 103 may be discharged. When the recording sheet 103 is discharged on the sheet jogging tray 101, the pusher paddle 102*a* may push the recording sheet 103. An edge of the recording sheet 103 may contact the jogging plate 102*b* facing the pusher paddle 102*a*, and the recording sheet 103 may be aligned.

However, a side of the recording sheet 103 may be curled after an image fixing process in the electrographic method as illustrated in FIG. 1. In such a case, the curled region may absorb the force of the pusher paddle 102*a*. Therefore, the recording sheet 103 may not be aligned.

SUMMARY

Example embodiments are directed to an image forming apparatus which may more effectively perform sheet alignment. Example embodiments are directed to an image forming apparatus which may have a reduced size.

In example embodiments, an image forming apparatus may include an image forming mechanism configured to form an image and transfer the image onto a sheet member, and/or a sheet processing unit. The sheet processing unit may include a sheet aligning unit, an ejection sheet tray configured to stack the sheet member, a sheet stopper configured to align the sheet member at a trailing edge thereof, a return mechanism configured to return the sheet member stacked on the ejection sheet tray to the sheet stopper, and/or a discharging mechanism configured to discharge the sheet member, aligned by the return mechanism, from the sheet stopper to the ejection sheet tray. The sheet aligning unit may include a stacking mechanism configured to stack the sheet member transferred into the sheet aligning unit, and/or a sheet aligning mechanism configured to align the sheet member.

In another example, a sheet processing unit may include a sheet aligning unit, an ejection sheet tray configured to stack the sheet member, a sheet stopper configured to align the sheet member at a trailing edge thereof, a return mechanism configured to return the sheet member stacked on the ejection sheet tray to the sheet stopper, and/or a discharging mechanism configured to discharge the sheet member, aligned by the return mechanism, from the sheet stopper to the ejection sheet tray. The sheet aligning unit may include a stacking mechanism configured to stack the sheet member transferred into the sheet aligning unit, and/or a sheet aligning mechanism configured to align the sheet member.

In another example, a sheet aligning unit may include a stacking mechanism configured to stack a sheet member transferred into the sheet aligning unit, and/or a sheet aligning mechanism configured to aligns a sheet member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
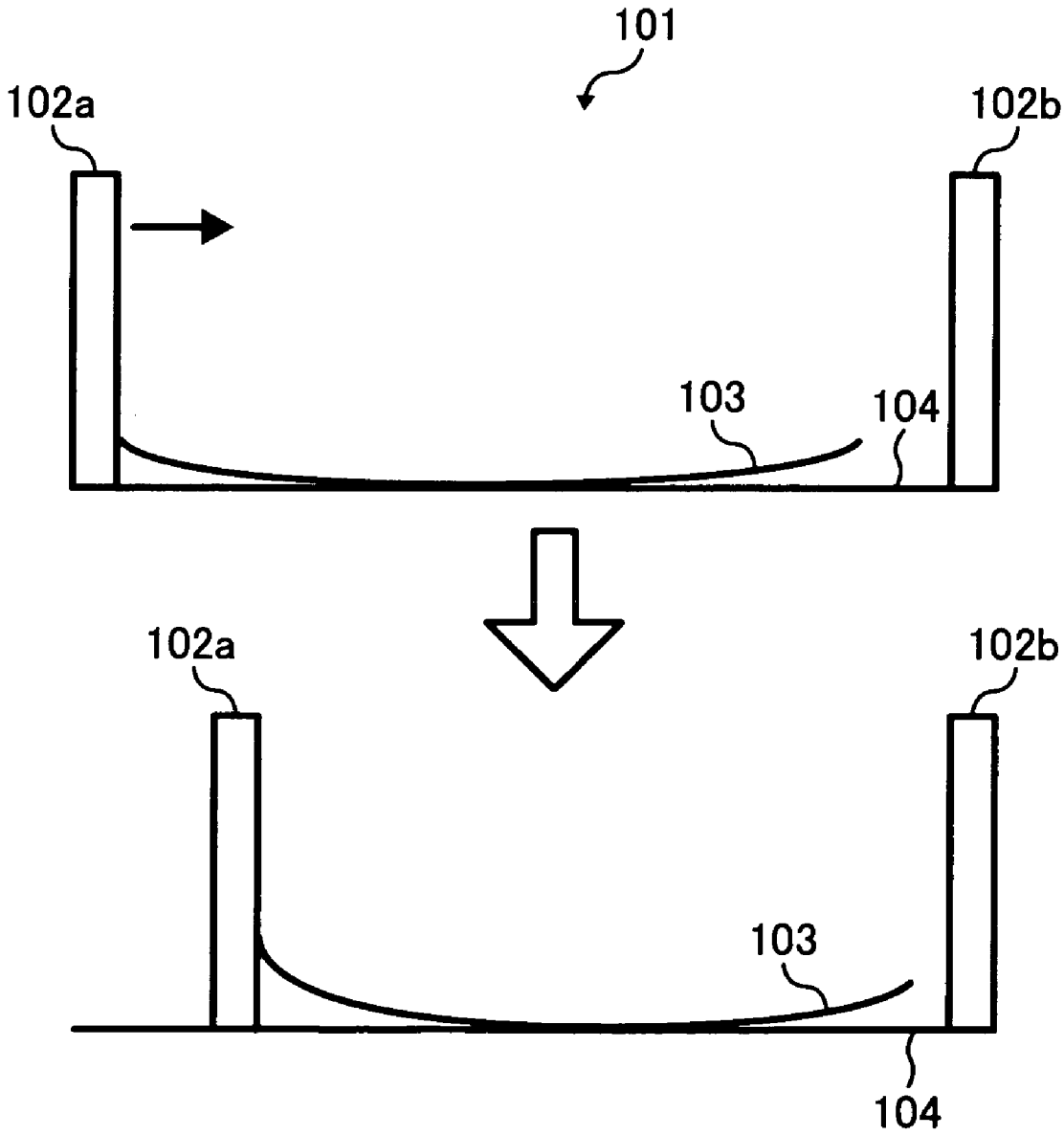
FIG. 1 PRIOR ART
FIG. 1 is an illustration of a relate-art sheet aligning unit.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 2, an image forming apparatus 100 according to example embodiments is described.

Figure 2:
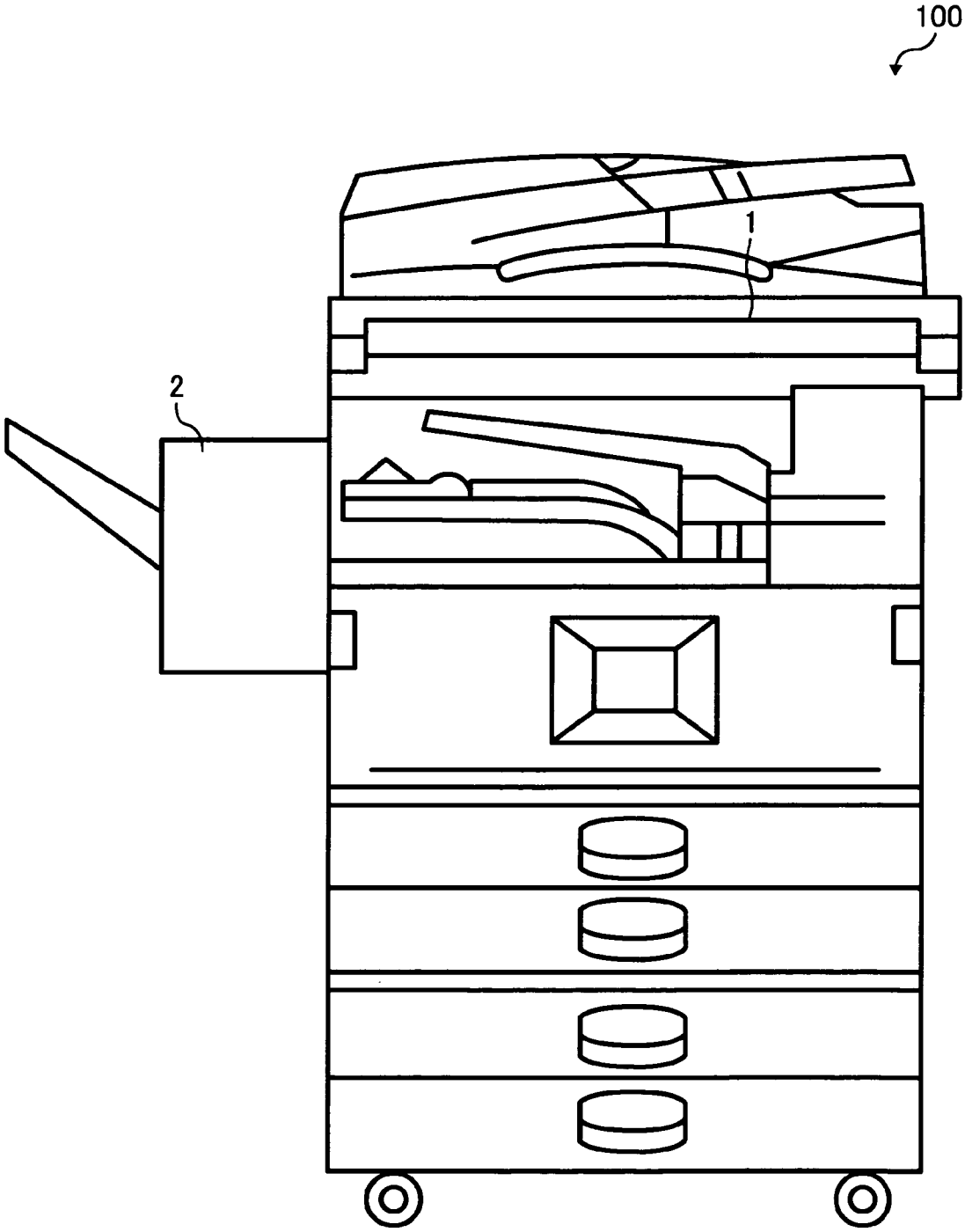
FIG. 2 is a schematic diagram of an image forming apparatus according to example embodiments.

Is illustrated in FIG. 2, the image forming apparatus 100 may include a main body 1 and/or a sheet processing unit 2. The main body 1 of the image forming apparatus 100 may include an image forming part, a fixing part, and/or a sheet discharge port (not shown) in its side. The image forming part forms an image and transfers the image on a sheet as a sheet member. The sheet processing unit 2 may be fixed on the side of the main body 1. From the sheet discharge port, a sheet on which an image is transferred is discharged to the sheet processing unit 2, where a predetermined or desired processing (post-processing , for example, stapling, punching, or the like) is performed.

Figure 3A:
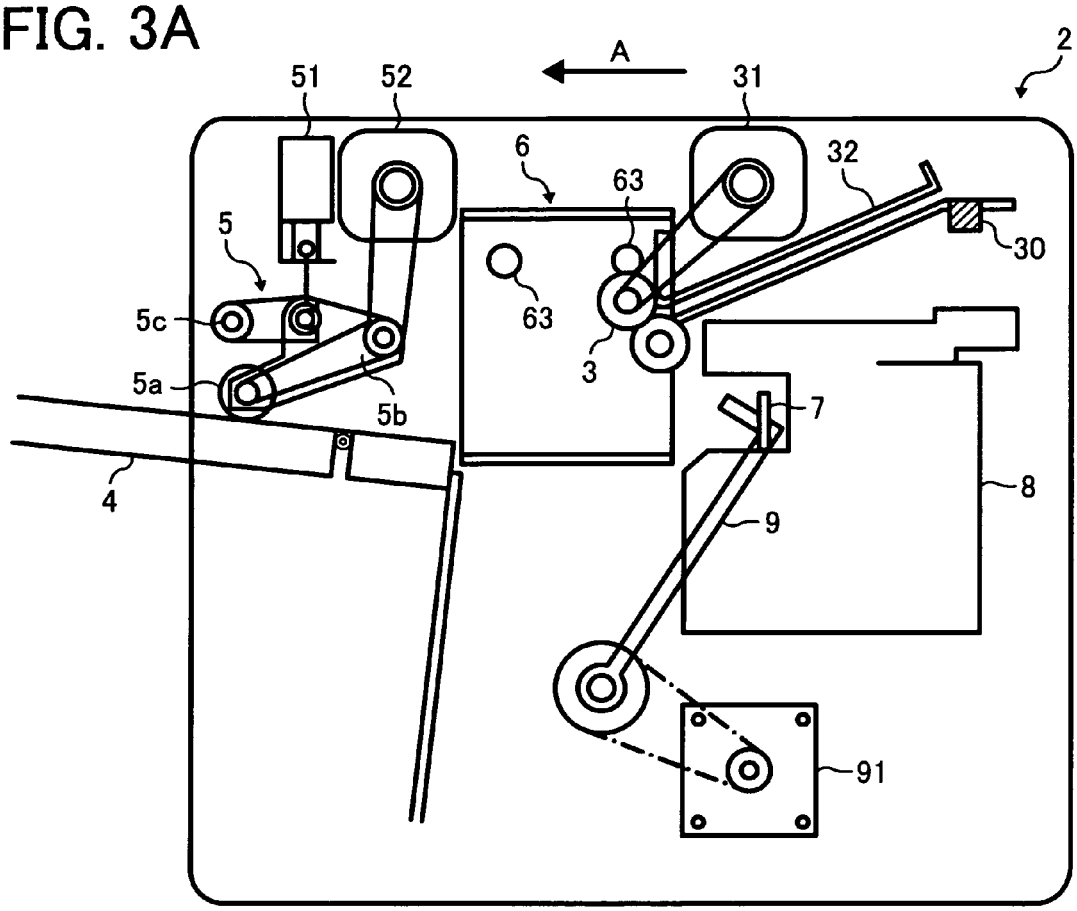
FIG. 3A is an example schematic diagram of a sheet processing unit of FIG. 2.

Details of the sheet processing unit 2 is described, referring to of FIG. 3A.

As illustrated in FIG. 3A, the sheet processing unit 2 may include an inlet roller 3, an ejection tray 4, a return roller 5, a jogger 6, a back-end fence 7, a stapler 8, and/or a discharge link 9.

The sheet processing unit 2 further may include an entrance sensor 30, transfer motor 31, and/or a transfer guide plate 32 around the inlet roller 3. Furthermore, a return solenoid 51 and a return motor 52 may be provided around the return roller 5, and/or a link motor 91 is provided near the discharge link 9. The return roller 5 may include a roller 5*a*, an arm 5*b*, and/or a rotation axis 5*c*. The jogger 6 may include a pair of guide bars 63.

The entrance sensor 30 provided at a most upstream part of the transfer guide plate 32 turns on, sensing arrival of a sheet sent from the main body 1. The transfer guide plate 32 may be provided at an inlet of the sheet processing unit 2, and guides the sheet to the inlet roller 3. The inlet roller 3 may be provided downstream of the transfer guide plate 32, and further sends the sheet toward the ejection tray 4. The transfer motor 31 may drive the inlet roller 3 to rotate. An arrow A shows a sheet transfer direction.

The return roller 5 as a return mechanism faces to a loading surface of the ejection tray 4, and sent back the sheet on the ejection tray 4 in a direction opposite to the arrow A so that an end of the sheet reaches the back-end fence 7. The roller 5*a* supported by the arm 5*b* may transfer the sheet. The arm 5*b* may be rotary supported by the rotation axis 5*c*. The return solenoid 51 drives the return roller 5 to swing around the rotation axis 5*c*. When the return solenoid 51 is on, the roller 5*a* may be lifted, and the return solenoid 51 is off, the roller 5*a* may descend under its own weight. That is, the return solenoid 51 may turn off when the roller 5*a* of the return roller 5 contacts a surface of a sheet to send back the sheet, and may turn on when the roller 5*a* draws apart from the sheet. The return motor 52 drives the roller 5*a* to rotate.

The sheets may lie over both the ejection tray 4 and jogger 6, and may be jogged by the jogger 6 as a sheet aligning unit. The jogger 6 may be supported by the guide bars 63. The back-end fence 7 as a sheet stopper may align the end of the sheets that is upstream side in the sheet transfer direction. The stapler 8 as a stitching mechanism may be provided near the back-end fence 7, and staples near the end of the sheets aligned by the back-end fence 7. The discharge link 9 as a discharge mechanism may be moved from the ejection tray 4 to the back-end fence 7 by a link mechanism (not shown) driven by the link motor 91. The discharge link 9 transfers the sheet whose end reaches the back-end fence 7 onto the ejection tray 4.

Figure 3B:
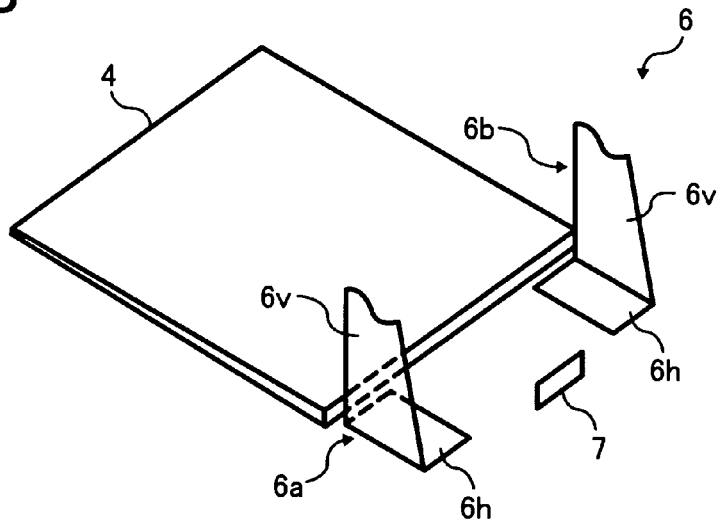
FIG. 3B is an example perspective view of a jogger included in the sheet processing unit of FIG. 3A.

As illustrated in FIG. 3B, the jogger 6 may include a front jogger 6*a* and/or a back jogger 6*b*. Each of the front jogger 6*a* and back jogger 6*b* may include a vertical part 6*v* and/or a loading part 6*h*. The front jogger 6*a* may align a side of the sheets that parallels the sheet transfer direction shown as an arrow A, and the back jogger 6*b* aligns an opposite side of the sheets (transverse alignment). The vertical part 6*v* may act on an edge surface of the sheets, and the sheets are loaded on the loading part 6*h*. The jogger 6 has a function as a sheet loading part since the loading part 6*h* supports the sheets, in addition to the transverse alignment function. Thus, an aligning mechanism, for example a jogger 6, may have a function to support a sheet in example embodiments.

FIGS. 4 to 7 illustrate actions of the sheet processing unit 2.

Figure 4:
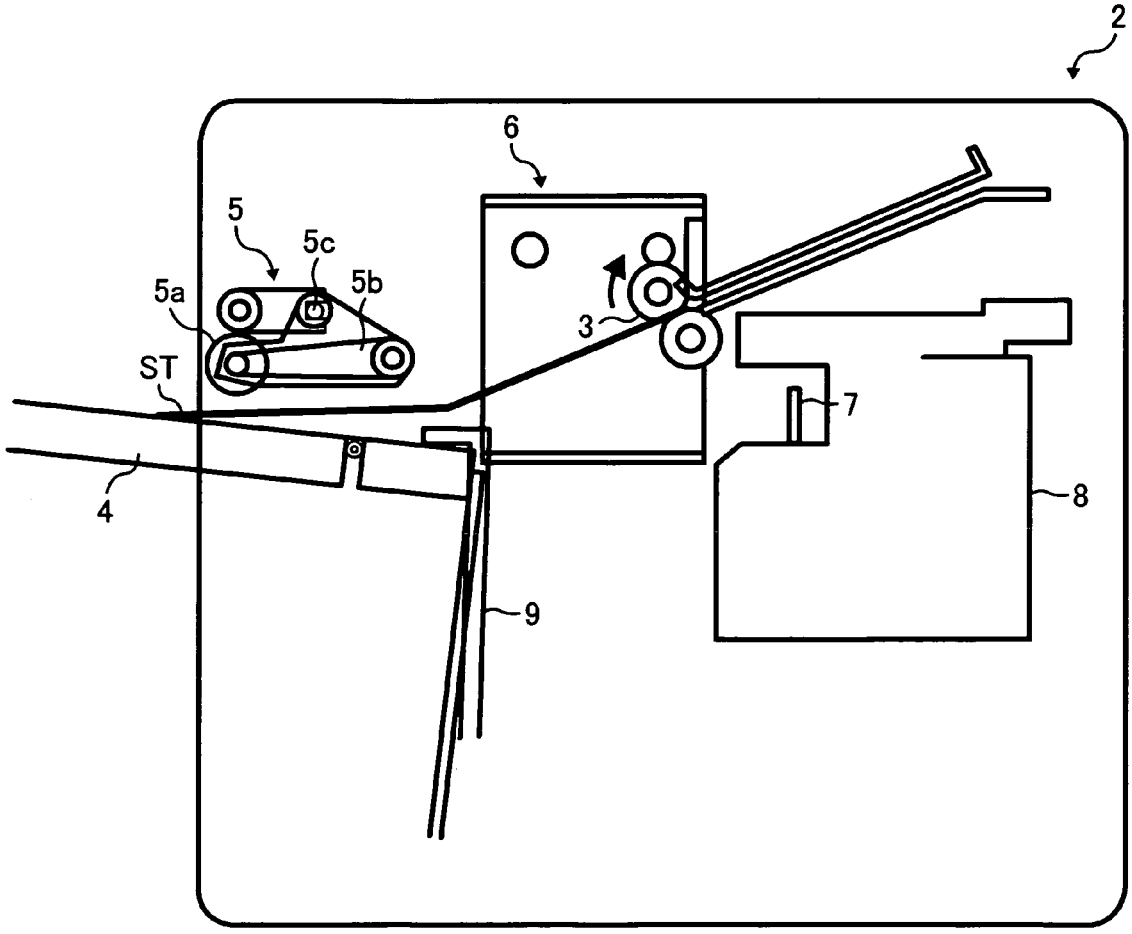
FIG. 4 is an example schematic diagram illustrating an action of the sheet processing unit of FIG. 3A.

FIG. 4 illustrates a state that a sheet ST may be transferred to the ejection tray 4 and jogger 6, after passing through the inlet roller 3. In this state, the return roller 5 may be at an evacuation position away from the loading surface of the ejection tray 4.

Figure 5:
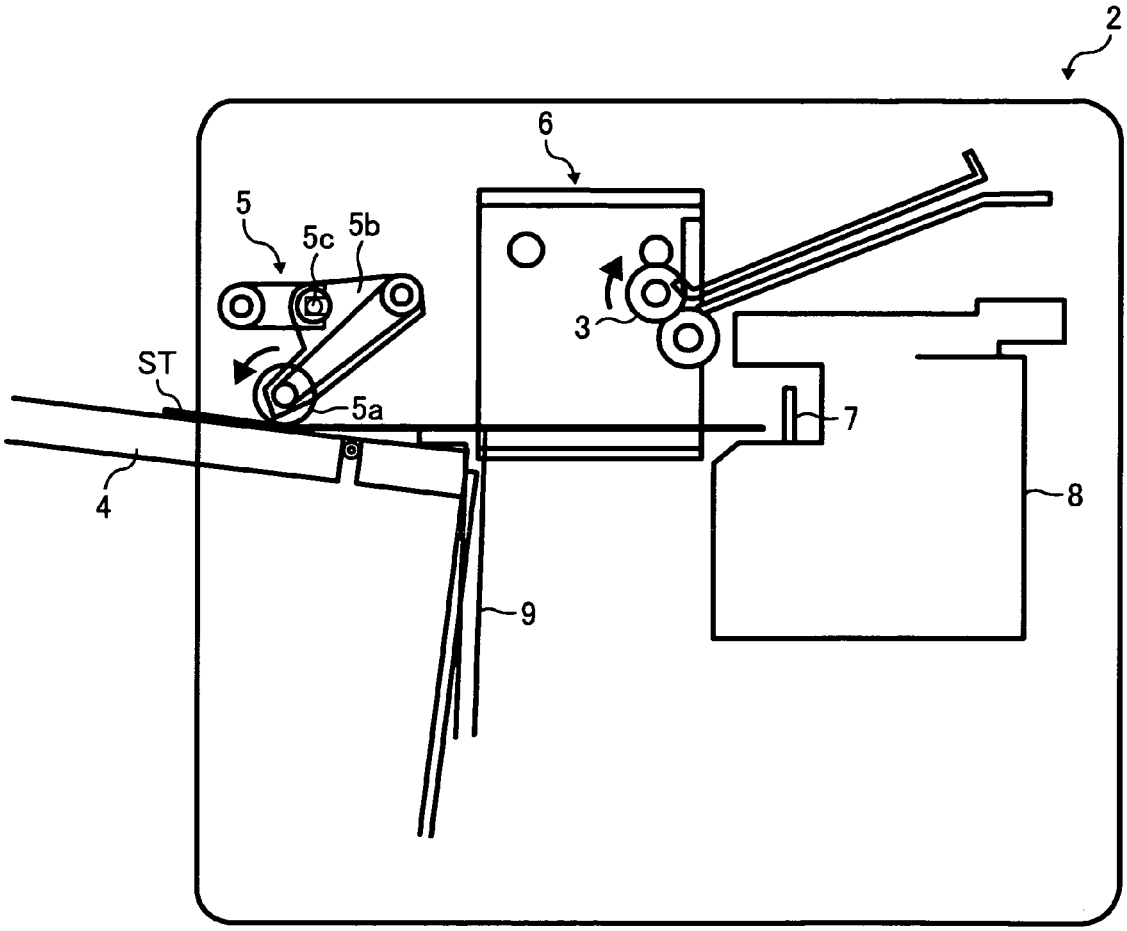
FIG. 5 is an example schematic diagram illustrating another action of the sheet processing unit of FIG. 3A.

In FIG. 5, the return roller 5 may rotate around the rotation axis 5*c*, so that the roller 5*a* may contact a surface of the sheet ST that may be discharged onto the ejection tray 4 and the jogger 6. The roller 5*a* may rotate to transfer the sheet ST toward the back-end fence 7.

Figure 6:
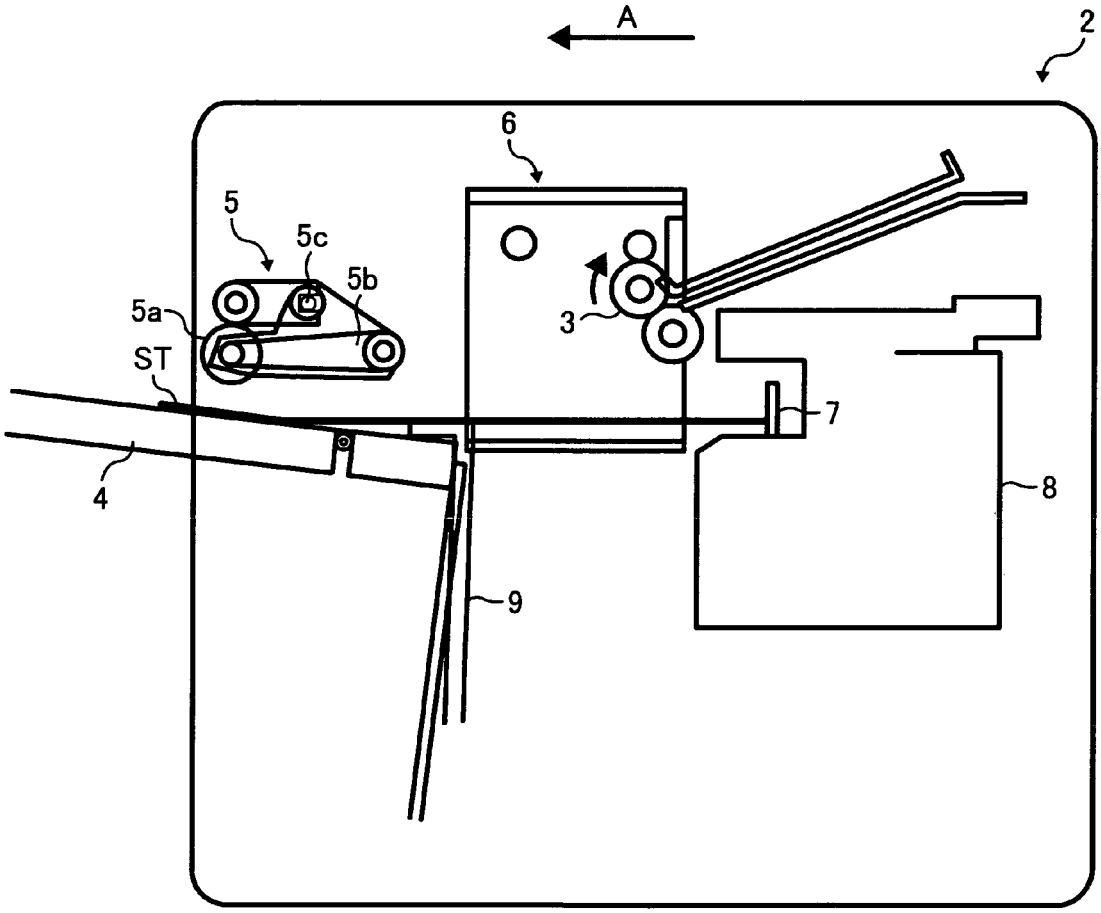
FIG. 6 is an example schematic diagram illustrating another action of the sheet processing unit of FIG. 3A.
Figure 7:
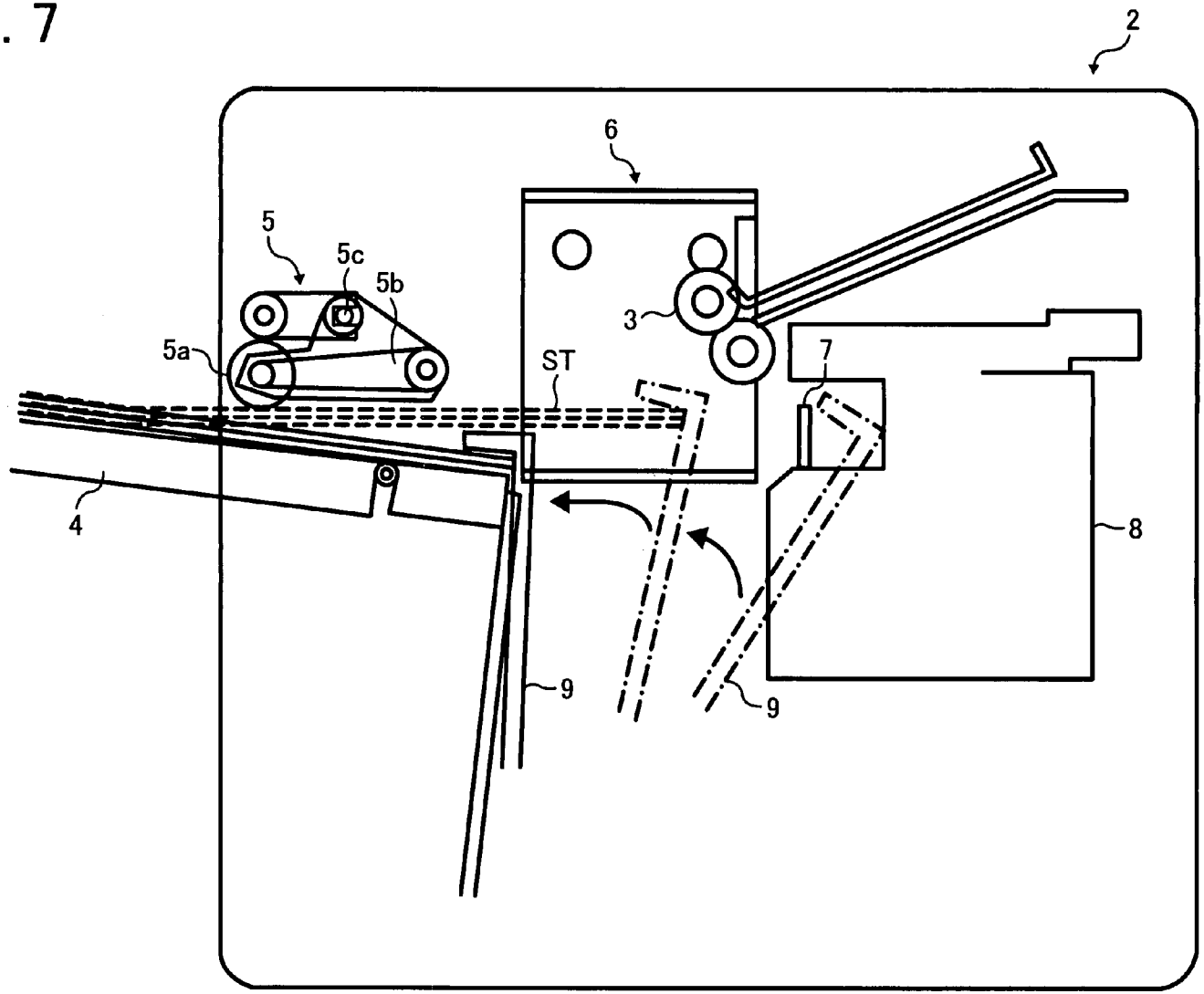
FIG. 7 is an example schematic diagram illustrating another action of the sheet processing unit of FIG. 3A.

FIG. 6 illustrates a state that the roller 5*a* of the return roller 5 ascends to the evacuation position after the sheet ST reaches the back-end fence 7 and may be aligned in the transfer direction shown as an arrow A. The jogger 6 may be at a waiting position at a predetermined or desired distance from each side of the sheet ST that is parallel to the sheet transfer direction before the roller 5*a* moves to the evacuation position. When the roller 5*a* moves to the evacuation position, the jogger 6 moves to push the sheet ST from both sides. Thus, the sides of the sheet ST that is parallel to the sheet transfer direction are aligned (transverse alignment). The sheet processing unit 2 repeats the action of FIG. 4 through FIG. 6 for a number of times equal to a designated number of sheets to be printed. Next, the stapler 8 staples a plurality of sheets ST stacked as in FIG. 6 when stapling processing is to be performed.

FIG. 6 illustrates a state that a plurality of sheets ST may be transferred to the ejection tray 4 by the discharge link 9 after alignment or stapling is performed.

According to example embodiments, sheets are loaded spreading over the ejection tray 4 and jogger 6 regardless of whether or not the stapling processing is to be performed. Therefore, a common configuration and a common member for sheet alignment may be used regardless of whether or not sheet alignment, stapling, etc. are to be performed. Further, an aligning mechanism, for example, the jogger 6, may also serve to support sheets. Therefore, the mechanism may be downsized, which may lead to simplification, weight reduction, and/or cost reduction of an image forming apparatus.

Figure 8:
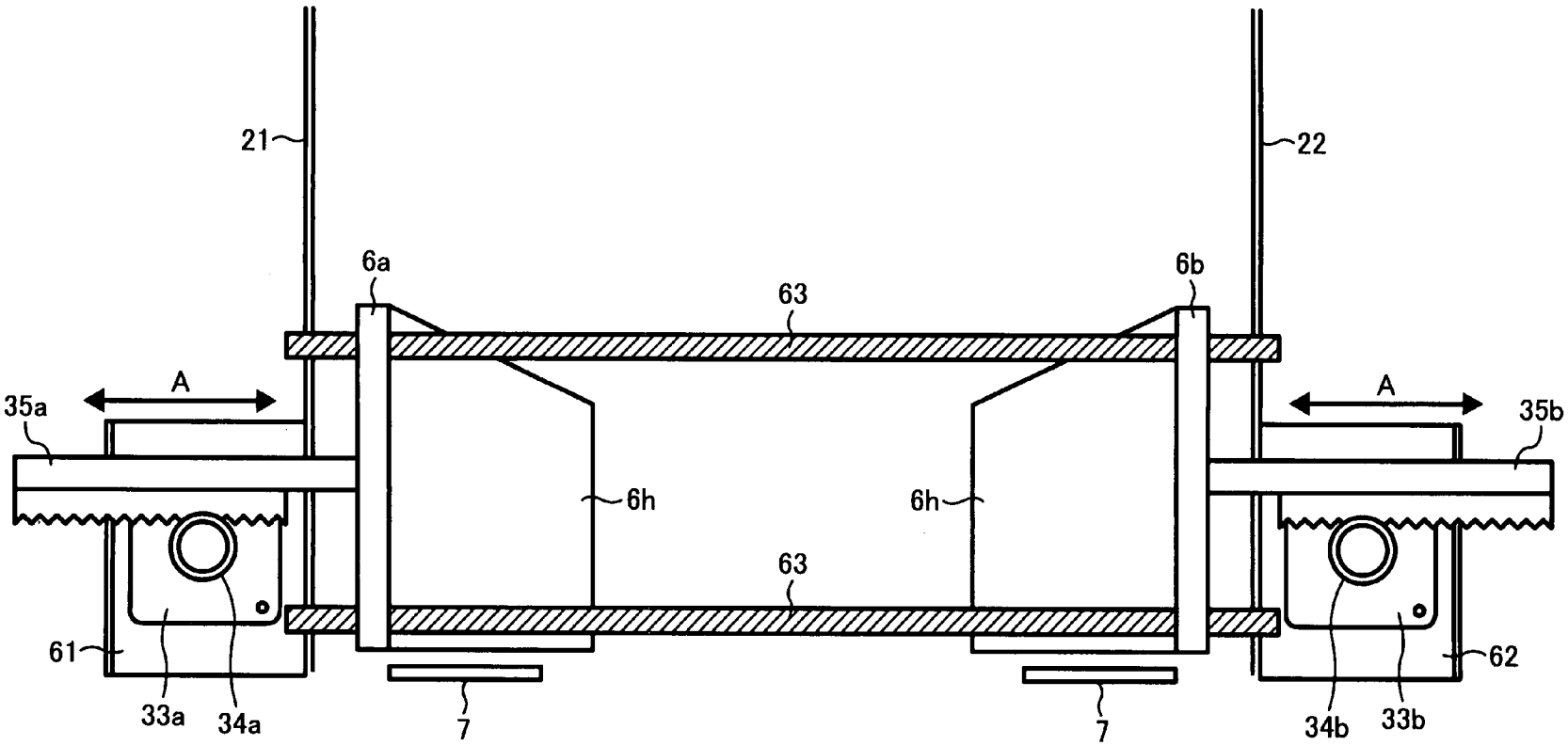
FIG. 8 is an example schematic diagram illustrating the jogger and its driving mechanism.

Next, a driving mechanism of the jogger 6 is described. FIG. 8 illustrates the jogger 6 and its driving mechanism. The sheet processing unit 2 may include a front frame 21, and/or a back frame 22. The driving mechanism of the jogger 6 may include a motor housing 61, another motor housing 62, a rack 35*a*, and/or another rack 35*b*. The motor housing 61 contains a jogger motor 33*a* and/or a pinion 34*a*, and the motor housing 62 contains another jogger motor 33*b* and/or another pinion 34*b*.

The jogger motor 33*a* in the motor housing 61 provided outside of the front frame 21 may drive the front jogger 6*a*. Likewise, the jogger motor 33*b* in the motor housing 62 provided outside of the back frame 22 may drive the back jogger 6*b*. The pair of guide bars 63 may be provided in parallel across the front frame 21 and back frame 22. As illustrated in FIG. 8, the front jogger 6*a* and back jogger 6*b* move back and forth along the guide bars 63 in a direction of an arrow A that is perpendicular to the sheet transfer direction. The pinions 34*a* and 34*b* may be provided at an axis of the jogger motors 33*a* and 33*b*, respectively. The racks 35*a* and 35*b* may be provided on the front jogger 6*a* and back jogger 6*b*, respectively. The pinion 34*a* engages the rack 35*a* to transmit driving forth of the jogger motors 33*a* to the front jogger 6*a*. Likewise, the pinion 34*b* engages the rack 35*b* to transmit driving forth of the jogger motors 33*b* to the back jogger 6*b*.

Figure 9A:
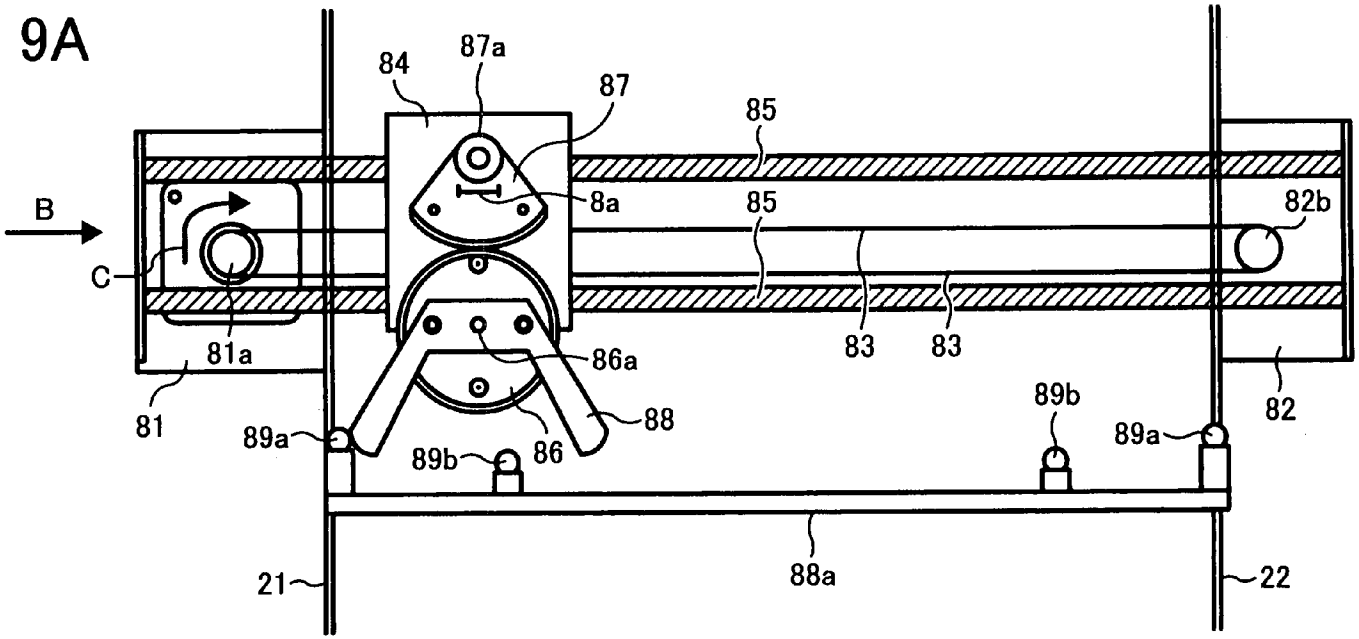
FIG. 9A is an example schematic diagram illustrating a stapler and its driving mechanism according to example embodiments.

Next, a driving mechanism of the stapler 8 is described in detail. As illustrated in FIG. 9A, the driving mechanism of the stapler 8 may include a motor housing 81, a pulley housing 82, a timing belt 83, a base 84, a pair of guide bars 85, a gear 86, a sector gear 87, and/or a lever 88. The motor housing 81 may be provided outside of the front frame 21, and may include a stapler motor 81*a*. The pulley housing 82 may be provided outside of the back frame 22, and may include a pulley 82*a*. The driving mechanism of the stapler 8 further may include a gear axis 86*a*, a sector gear axis 87*a*, a lever driving member 88*a*, a pair of first pins 89*a*, and/or a pair of second pins 89*b*. The stapler 8 may be provided on the sector gear 87. Although FIG. 9A illustrates a state that the stapler 8 is not provided, a stapling position 8*a* is illustrated in the sector gear 87.

The stapler motor 81*a* may include a rotation axis and/or a pulley fitted around the rotation axis. Between the pulley 82*a* and pulley of the stapler motor 81*a*, the timing belt 83 may be provided in a tensioned state. The base 84 may be fixed on the timing belt 83, and slidably supported by the pair of guide bars 85 provided in parallel across the front frame 21 and back frame 22.

On the base 84, the gear 86 may be rotatably attached on the gear axis 86*a* protruding from the base 84. Likewise, the sector gear 87 may be rotatably attached on the sector gear axis 87*a* protruding from the base 84. The sector gear 87 engages with the gear 86, and rotated around the sector gear axis 87*a* by rotation of the gear 86. The lever 88 provided on the gear 86 may be penetrated by the gear axis 86*a*. The lever 88 may be for setting rotation angle of the gear 86. The pins 89*a* and pins 89*b* may be provided on the lever driving member 88*a* in a standing manner.

Figure 9B:
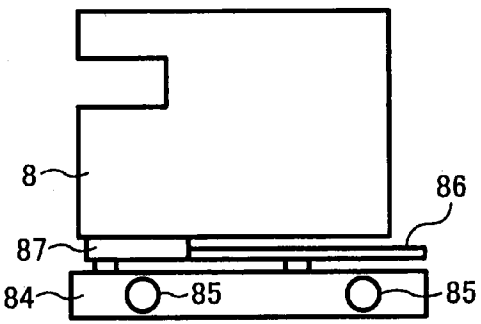
FIG. 9B is an example plain view of the stapler and its transfer mechanism of FIG. 9A viewed from a direction of an arrow B.

FIG. 9B illustrates a state that the stapler 8 is installed on the sector gear 87 on the base 84. The stapler 8 integrally moves with the base 84 along the guide bars 85 in a direction perpendicular to the sheet transfer direction, and integrally rotates with the sector gear 87. Therefore, the stapler 8 according example embodiments may perform one-point parallel stapling, two-points parallel stapling, corner stapling, and the like.

The pins 89*a*, pins 89*b*, and/or driving force of the stapler motor 81*a* control an angle of the lever 88. By contacting the lever 88, each of the pins 89*a* rotates the lever 88 by 45 degrees so that the stapler 8 staples sheets at 45 degrees with respect to a side of the sheets. Each of the pins 89*b* returns the lever 88 rotated by the pins 89*a* to an original angle at which the stapler 8 staples the sheets in parallel with the side of the sheets. Therefore, the pins 89*a* may be provided so that the lever 88 contacts either of the pins 89*a* when the lever 88 approaches or reaches the front frame 21 or back frame 22, and the gear 86 is rotated. Likewise, the pins 89*b* may be provided so as not to contact the lever 88 that is at the original angle when the stapler 8 moves.

FIG. 9A illustrates a state that the stapler 8 staples one point of the sheets in parallel with the side of the sheet perpendicular to the sheet transfer direction. In this state, the lever 88 may be at a stop and a left part of the lever 88 may be in contact with the pin 89*a*. When the stapler motor 81*a* rotates clockwise in FIG. 9A (an arrow C) from this state, the pin 89*a* pushes the lever 18 and the gear 86 rotates counterclockwise. As a result, the sector gear 87 may be rotated clockwise. When the sector gear 87 is rotated 45 degrees, the stapler motor 81*a* stops. In conjunction with the sector gear 87, the stapler 8 may be rotated 45 degrees and the stapling position 8*a* is at 45 degrees to the side of the sheets. In this state, a tip of the left part of the lever 88 may be at a lower position than a position of a tip of the pin 89*b*. When the stapler 8 staples the sheets in this state, corner stapling may be performed.

To perform one-point parallel stapling or two-points parallel stapling from the state of the above corner stapling, the stapler motor 81*a* may be rotated counterclockwise that is a direction opposite to the arrow C. Therefore, the timing belt 83 similarly rotates counterclockwise, which moves the gear 86 toward the back frame 37*b*. In this state, the gear 86 remains at 45 degrees. Then, the tip of the lever 88 contacts the pin 89*b*, which rotates the gear 86 clockwise. The gear 86 stops rotating when the tip of the lever 88 is at a position over the pin 89*b*. As a result, the stapling position 8*a* may be in parallel with the side of the sheets. Then, the stapler 8 may be moved to a predetermined or desired position and performs stapling or waits for another action.

When the gear 86 is rotated in conjunction the lever 88 contacting the pin 89*a* near the back frame 22, the stapler 8 staples perpendicular to the above stapling in which the lever 88 contacts the pin 89*a* near the front frame 21.

Figure 10:
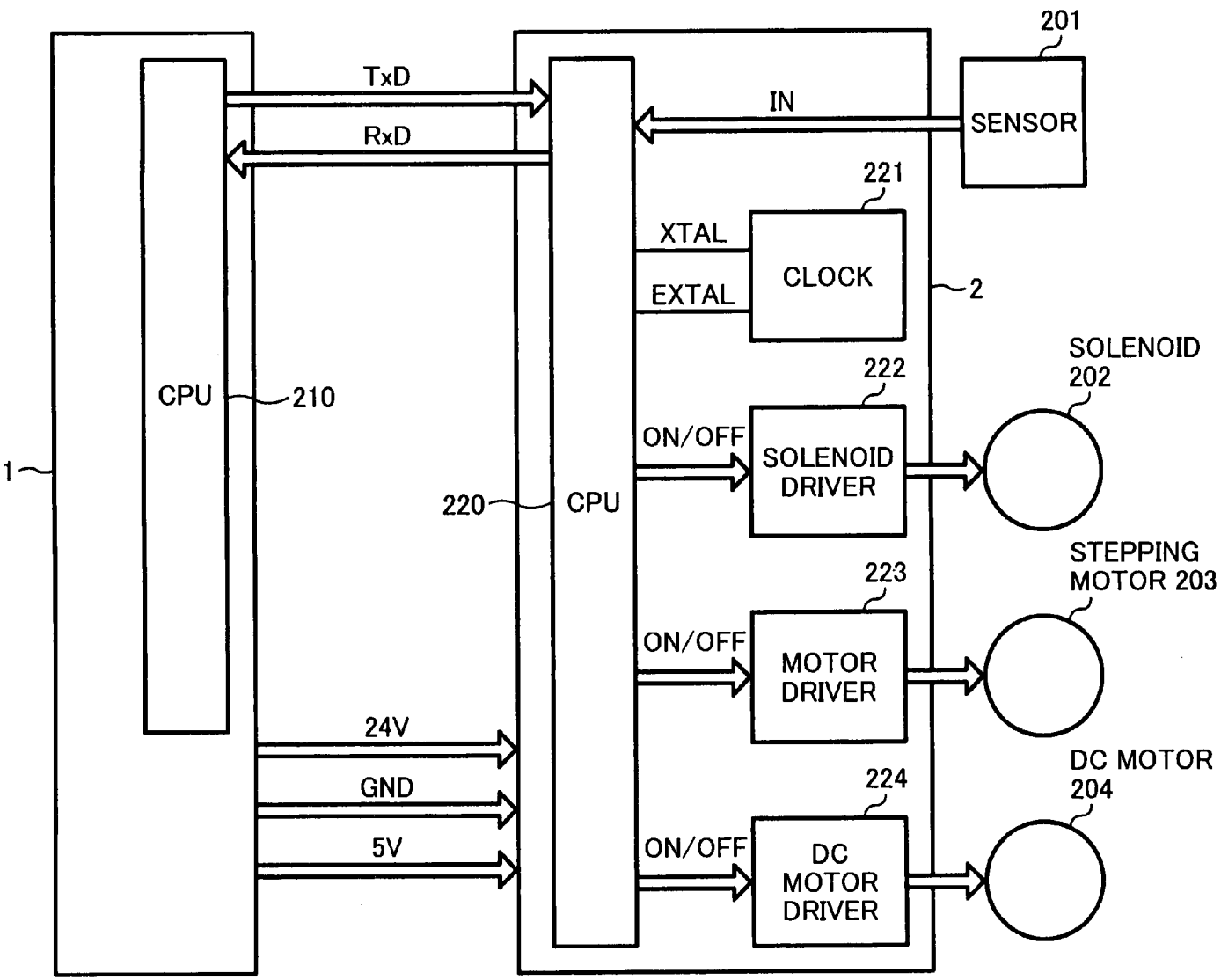
FIG. 10 is an example block diagram of an electric control system of the image forming apparatus illustrated in FIG. 2.

Next, an electric control system of the image forming apparatus 100 of FIG. 2 is described, referring to FIG. 10. The main body 1 of the image forming apparatus 100 may include a CPU (central processing unit) 210. The sheet processing unit 2 may include a CPU (central processing unit) 220, a plurality of sensors 201, a solenoid 202, a stepping motor 203, a DC (direct current) motor 204, a clock generator 221, a solenoid driver 222, motor stepping motor driver 223, and/or a DC motor driver 224.

The CPU 210 performs various controls, calculation, and the like regarding image forming processes. The CPUs 210 and 220 perform communications of a data transfer (TxD), a data receiving (RxD) and so forth with each other. The main body 1 of the image forming apparatus 100 supplies various powers including a driving power (24V) and a control power (5V) to the sheet processing unit 2. Both of the main body 1 and sheet processing unit 2 may be grounded to a same potential. Each of sensors 201 senses a state of the sheet processing unit 2, and outputs a signal of the state. The solenoid 202, the stepping motor 203, and the DC motor 204 may be different types of driving component used in the sheet processing unit 2, and may be electrically connected to the CPU 220 through the solenoid driver 222, the stepping motor driver 223, or the DC motor driver 224. The clock generator 221 may include crystal oscillation connection of XTAL and EXTAL, and generates a clock signal used by the CPU 220. The solenoid driver 222 drives the solenoid 202, the stepping motor driver 223 drives the stepping motor 203, and the DC motor driver 224 drives the DC motor 204. The CPU 220 outputs a driving signal to the solenoid driver 222, the stepping motor driver 223, or the DC motor driver 224, based on the output from the sensors 201 to control each part of the sheet processing unit 2.

Figure 11:
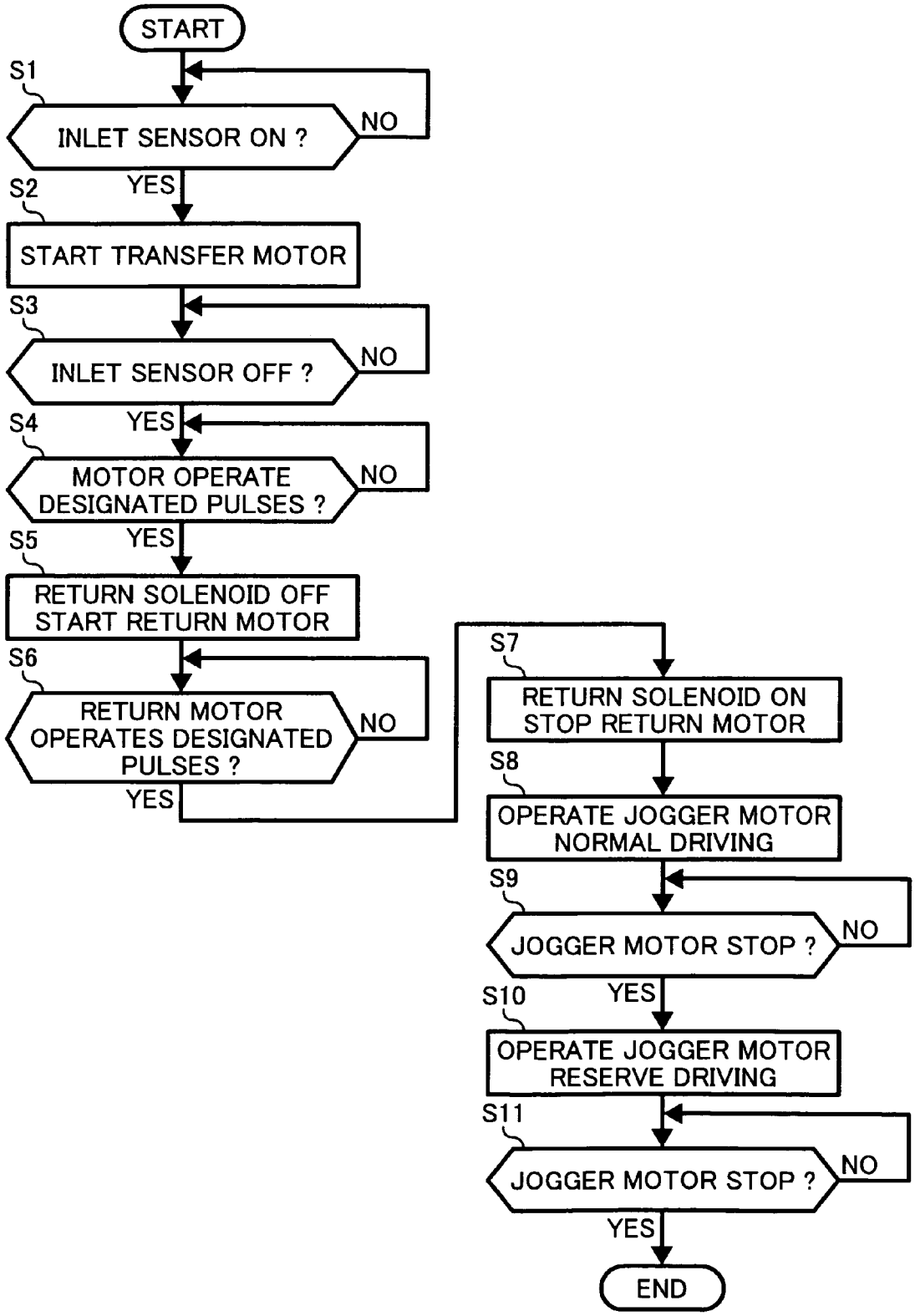
FIG. 11 is an example flowchart illustrating basic processes of aligning and stacking of sheets by the sheet processing unit of FIG. 3A.

Next, basic processes of the sheet processing unit 2 are explained with reference to flowcharts of FIGS. 11 and 12. FIG. 11 describes processes in which sheets may be aligned and stacked.

When a sheet arrives at the inlet of the sheet processing unit 2, an inlet sensor 30 senses the arrival of the sheet and turns on (S1). The transfer motor 31 starts to drive the inlet roller 3 (S2). The transfer guide plate 32 guides the sheet to the inlet roller 3. After a back end of the sheet passes a point where the inlet sensor 30 is provided, the inlet sensor 30 turns off (S3). After the transfer motor 31 drives the inlet roller 3 for designated pulses (S4), the return solenoid 51 turns off, and the roller 5*a* of the return roller 5 that is at the evacuation position move to contact a surface of the sheet. When the return roller 5 contacts the sheet, the return motor 52 starts (S5). The return motor 52 operates for designated pulses so that the return roller 5 transfers the sheet to a position that the back end of the sheet contacts the back-end fence 7 (S6). Next, the return solenoid 51 turns on, and the roller 5*a* disengages from the surface of the sheet. Upon disengaging of the roller 5*a* from the sheet, the return motor stops (S7). After the sheet is aligned in the sheet transfer direction by the return roller 5 and back-end fence 7, jogger motors 33*a* and 33*b* start normal driving to allow the front jogger 6*a* and back jogger 6*b* to approach the sheet (S8). When the jogger motors 33*a* and 33*b* operate for designated pulses, transverse alignment that is perpendicular to the sheet transfer direction may be performed. Then, the jogger motors 33*a* and 33*b* stop, and jogger 6 stops. In this state, the sheet may be sandwiched between the front jogger 6*a* and back jogger 6*b* (S9). The jogger motors 33*a* and 33*b* start reverse driving (S10). After operating for designated pulses, the jogger motors 33*a* and 33*b* stop and the jogger 6 disengage from the sheet (S11). In this state, the jogger 6 returns to the waiting position.

Figure 12:
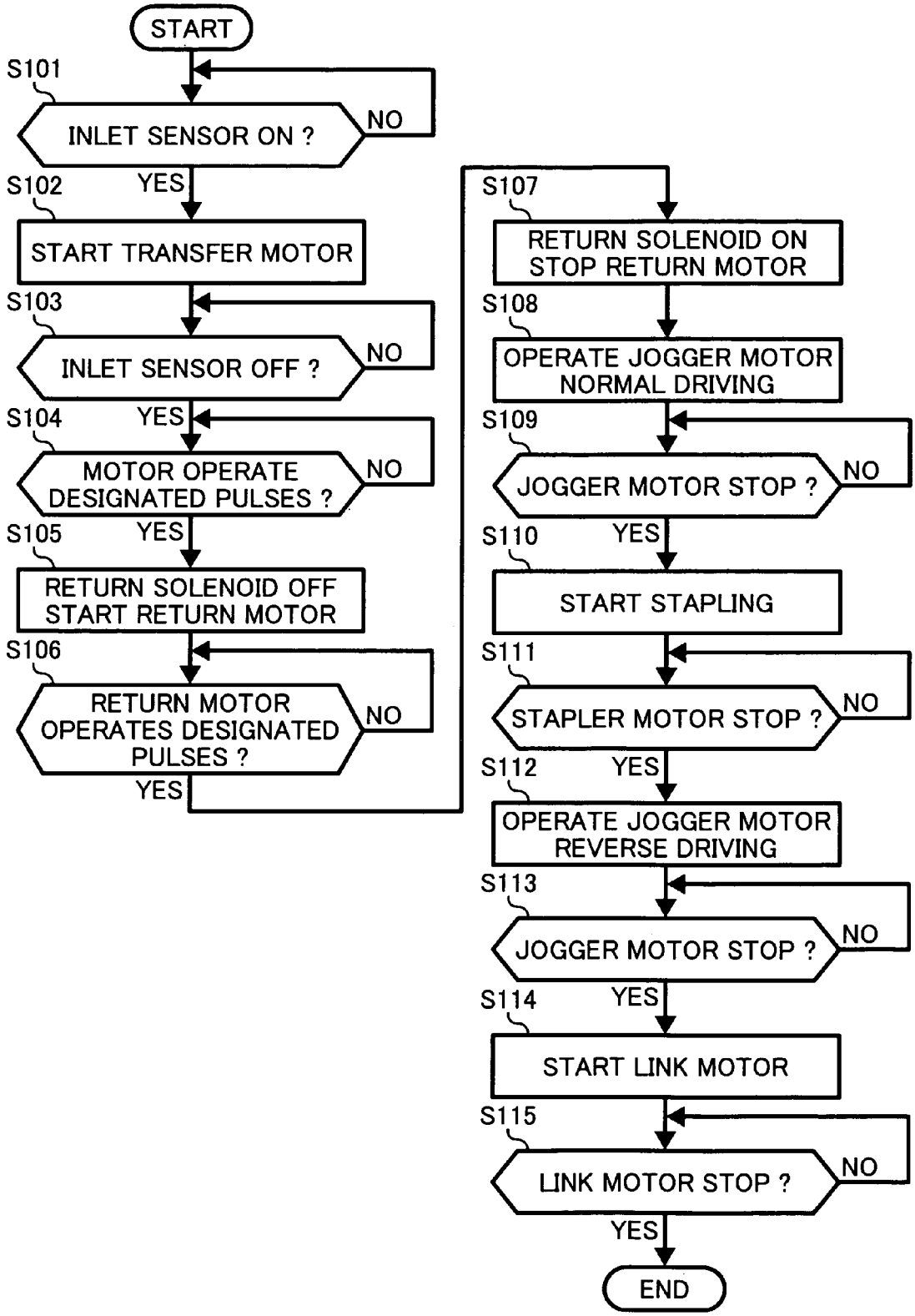
FIG. 12 is an example flowchart illustrating basic processes of stapling sheets by the sheet processing unit of FIG. 3A.

The flowchart of FIG. 12 illustrates processing of stapling. From S101 to S109, processes similar to S1 to S9 of FIG. 11 are performed. At S109, when the jogger motors 33*a* and 33*b* stop, the sheets may be sandwiched between the front jogger 6*a* and back jogger 6*b*. Then, the stapler 8 starts stapling (S110). When the stapler 8 finishes stapling, the stapler motor 81 stops (S111). Next, the jogger motors 33*a* and 33*b* operate reverse driving for designated pulses (S112). The jogger motor 16 stops when the jogger 6 returns to the waiting position (S113). Next, the link motor 91 drives the discharge link 9 to discharge the sheet onto the ejection tray 4 (S114). After the discharge link 9 completes the discharging action, the link motor 91 stops and the processing is completed.

The CPU 220 of the control system of the sheet processing unit 2 in FIG. 10 carries out a program for controlling the above processing described in the flowcharts of FIGS. 11 and 12. The program may be stored in a ROM (not shown), which the CPU 220 reads out. The CPU 220 develops the program in a RAM (not shown) and uses the RAM as a work area to execute the program. Alternatively, the control of the above processing may be carried out on hardware by using ASIC.

Figure 13:
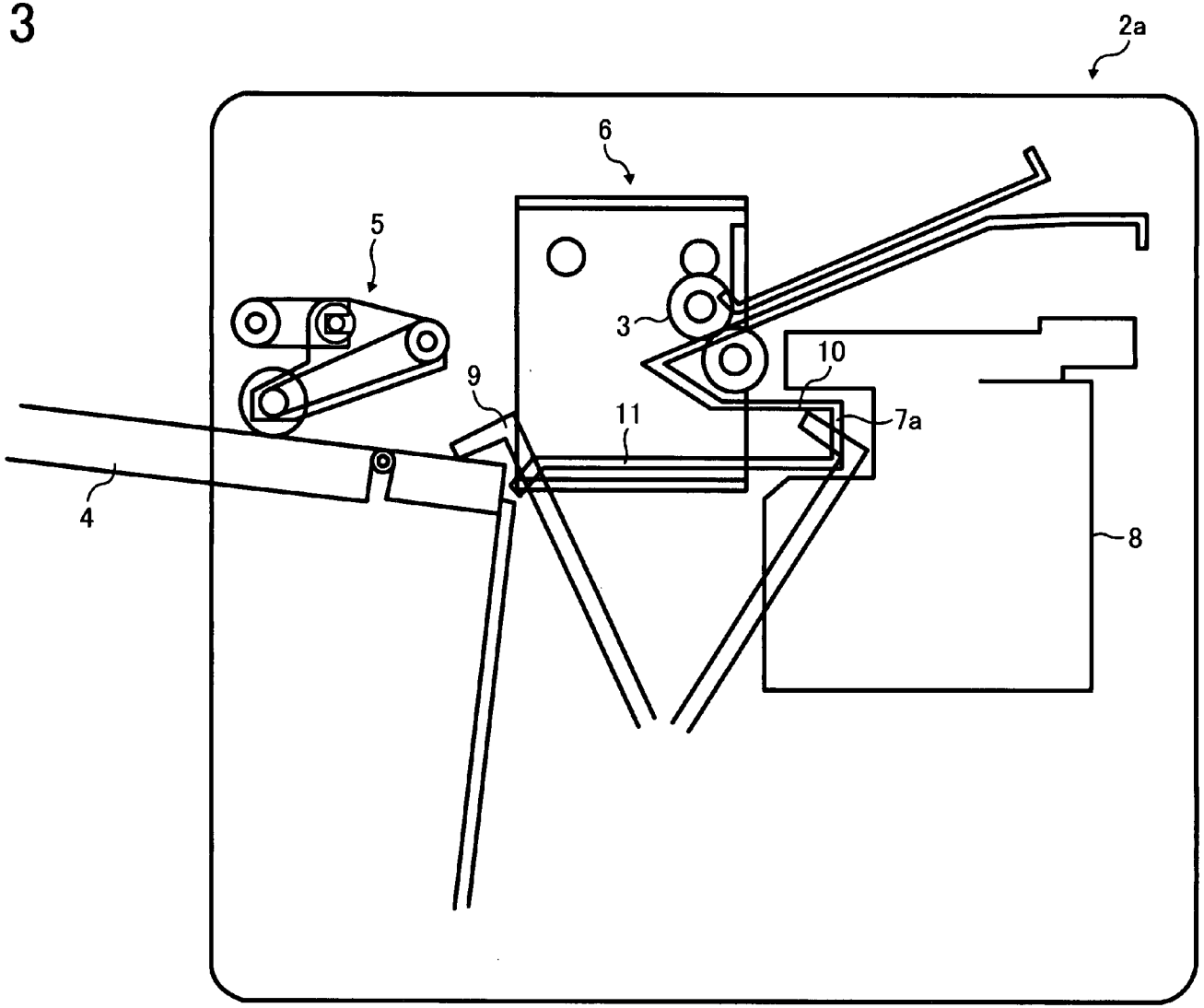
FIG. 13 is an example schematic diagram of a sheet processing unit according to example embodiments.

FIG. 13 illustrates a sheet processing unit 2*a* according to example embodiments.

The sheet processing unit 2*a* may include a back-end fence 7*a* that may be provided with an upper guide 10 and/or a loading part 11. Except the back-end fence 7*a*, each part of sheet processing unit 2*a* has a similar configuration and a similar function to each part of the sheet processing unit 2 of FIGS. 3 to 7.

Figure 14:
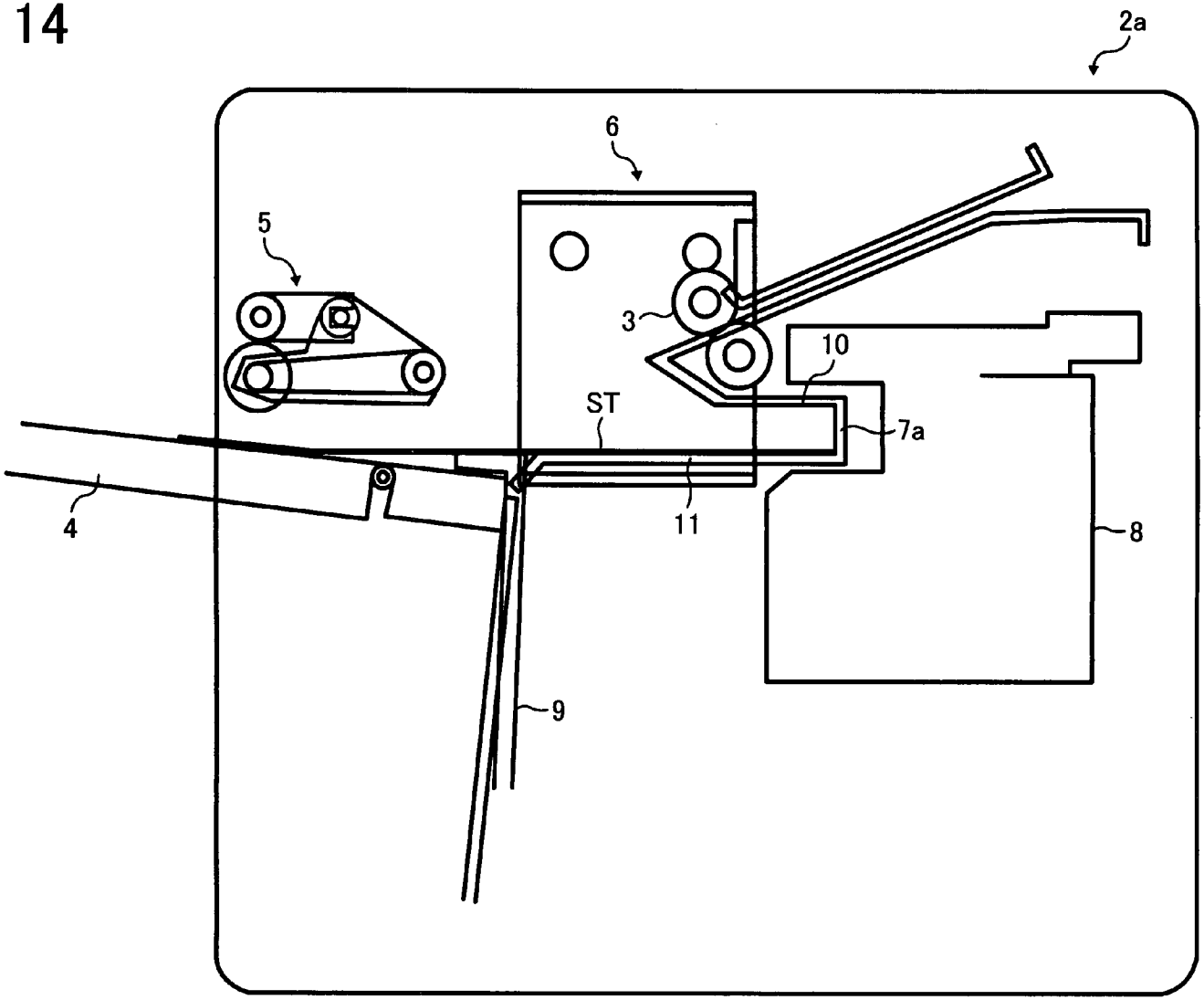
FIG. 14 is an example schematic diagram of the sheet processing unit of FIG. 13.

In FIG. 14, the return roller 5 may be at the evacuation position after transferring a sheet discharged on the ejection tray 4 to the back-end fence 7*a*. The state of FIG. 14 corresponds to FIG. 6. As illustrated in FIG. 14, a sheet ST lies over an ejection tray 4 and a jogger 6 similar to example embodiments of FIGS. 3 to 7. The upper guide 10 guides and regulates the sheet ST from above, and the loading part 11 of the back-end fence 7*a* supports the sheet ST from beneath.

According to example embodiments of FIGS. 13 and 14, when a back-end of a sheet member contacts an aligning mechanism for aligning the back-end of the sheet member, the sheet member may be supported from beneath and regulated from above. Therefore, the sheet member may be better aligned.

Next, example embodiments for aligning a sheet with a curled side are explained.

Figure 15:
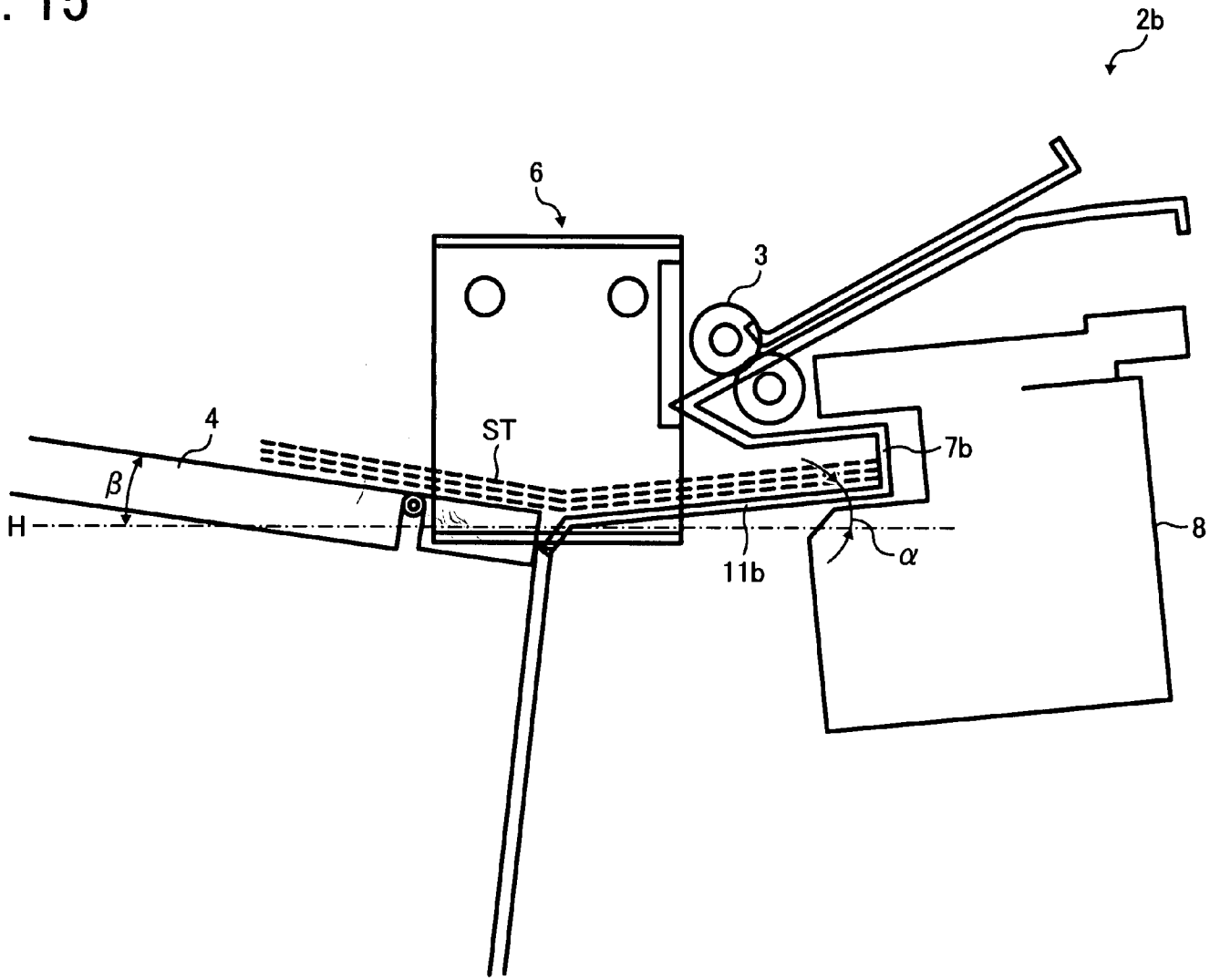
FIG. 15 is an example schematic diagram of a sheet processing unit according to example embodiments.

FIG. 15 illustrates a major portion of a sheet processing unit 2*b* according to example embodiments. The sheet processing unit 2*b* of FIG. 15 may include a back-fence 7*b* that may be configured so that a sheet member is loaded in a curved manner. Other than that each part of the sheet processing unit 2*b* has a similar configuration and a similar function to each part of the sheet processing unit 2*a* of FIGS. 13 and 14. The back-end fence 7*b* may include a loading part 11*b*, similar to the sheet processing unit 2*b*. FIG. 15 illustrates an inclination angle $\alpha$ of a loading part 11*b* of a back-end fence 7*b* and an inclination angle $\beta$ of a loading surface of the ejection tray 4 with respect to a horizontal line H.

In example embodiments of FIG. 15, a relation between the inclination angles $\alpha$ and $\beta$ need not be specified when an back-end fence 7*b* side of a loading part 11*b* is at a higher position than a position of its opposite side. When the back-end fence 7*b* side of the loading part 11*b* is at a lower position than the position of its opposite side, $\alpha$ is not equal to $\beta$ (not shown). More specifically, the loading part 11*b* of the back-end fence 7*b* and loading surface of the tray 4 need not be on a same plane. Therefore, a plurality of sheets ST may be curved.

Figure 16:
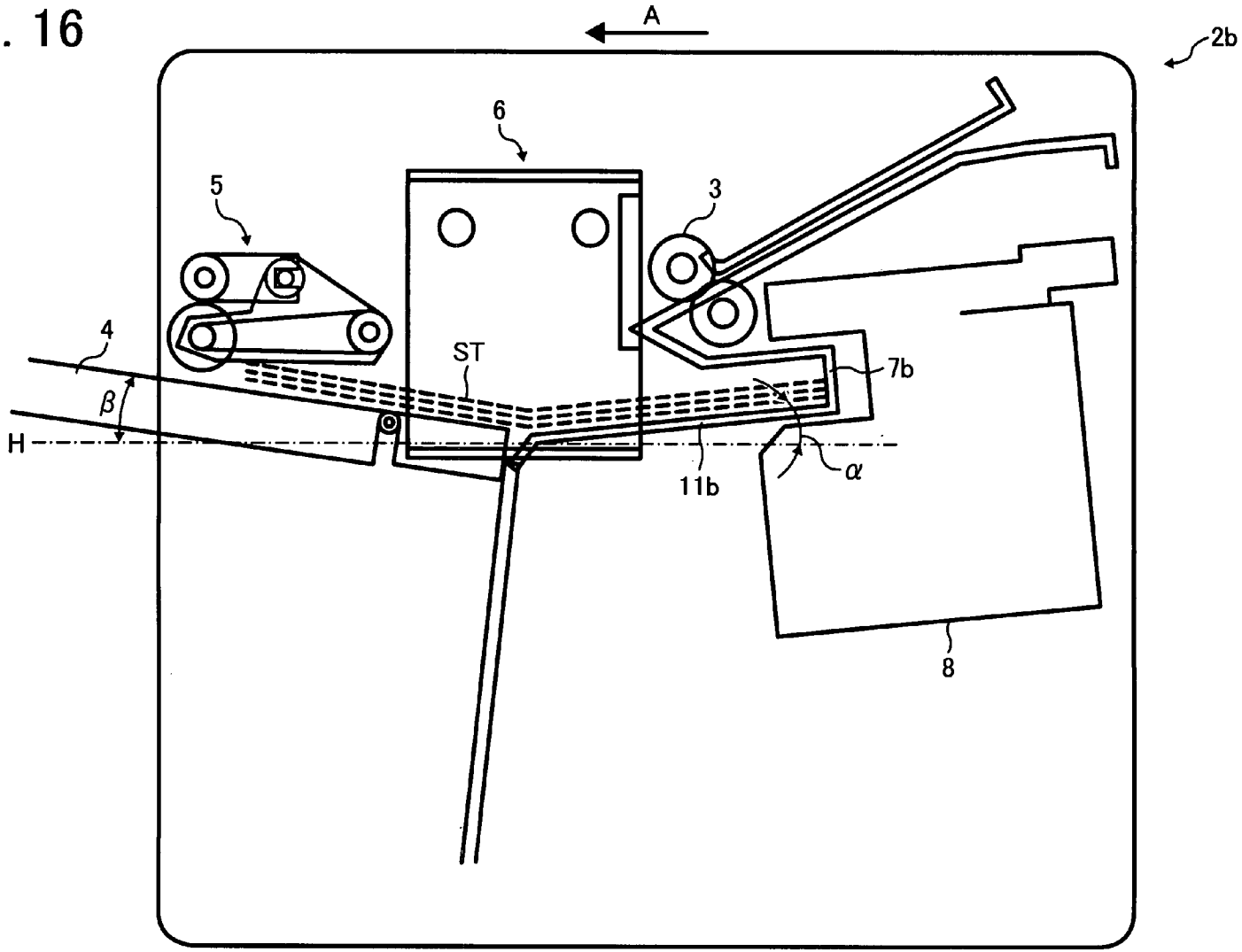
FIG. 16 is an example schematic diagram illustration an action of the sheet processing unit of FIG. 15.

FIG. 16 illustrates that the plurality of sheets ST placed in the sheet processing unit 2*b* may be curved in the sheet transfer direction shown as an arrow A. By curving the sheets ST as above, its side that curls in a direction perpendicular to the sheet transfer direction may be corrected.

According to example embodiments of FIGS. 15 and 16, a loaded sheet member may be curved in a direction perpendicular to a direction of a curled side of the sheet member. Therefore, the curled side of the sheet member may be corrected in a direction in which an aligning mechanism, e.g., a jogger, acts. Moreover, the aligning mechanism may more reliably transfer the sheet member to better align the sheet member.

Figure 17:
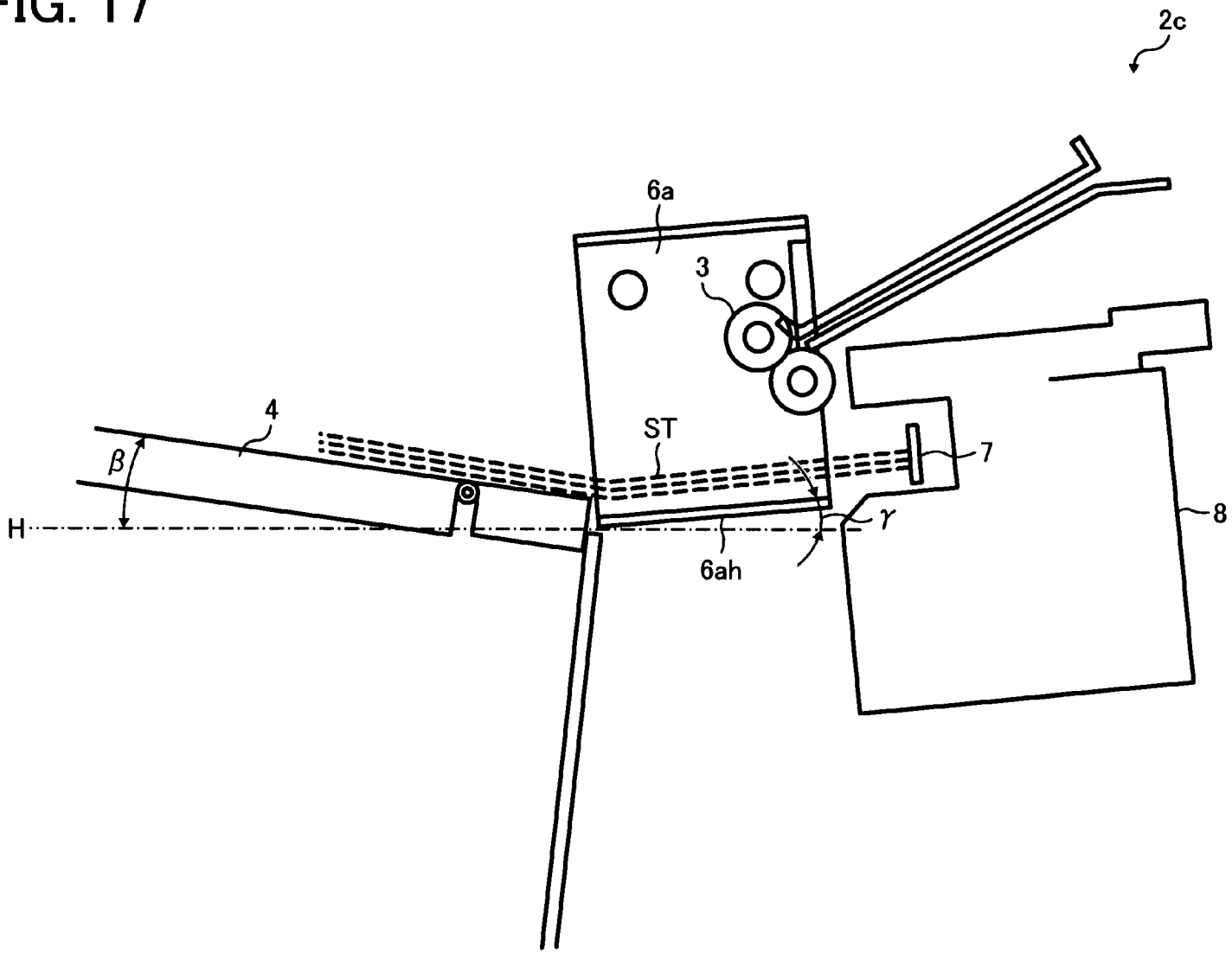
FIG. 17 is a schematic diagram of a sheet processing unit according to example embodiments.
Figure 18:
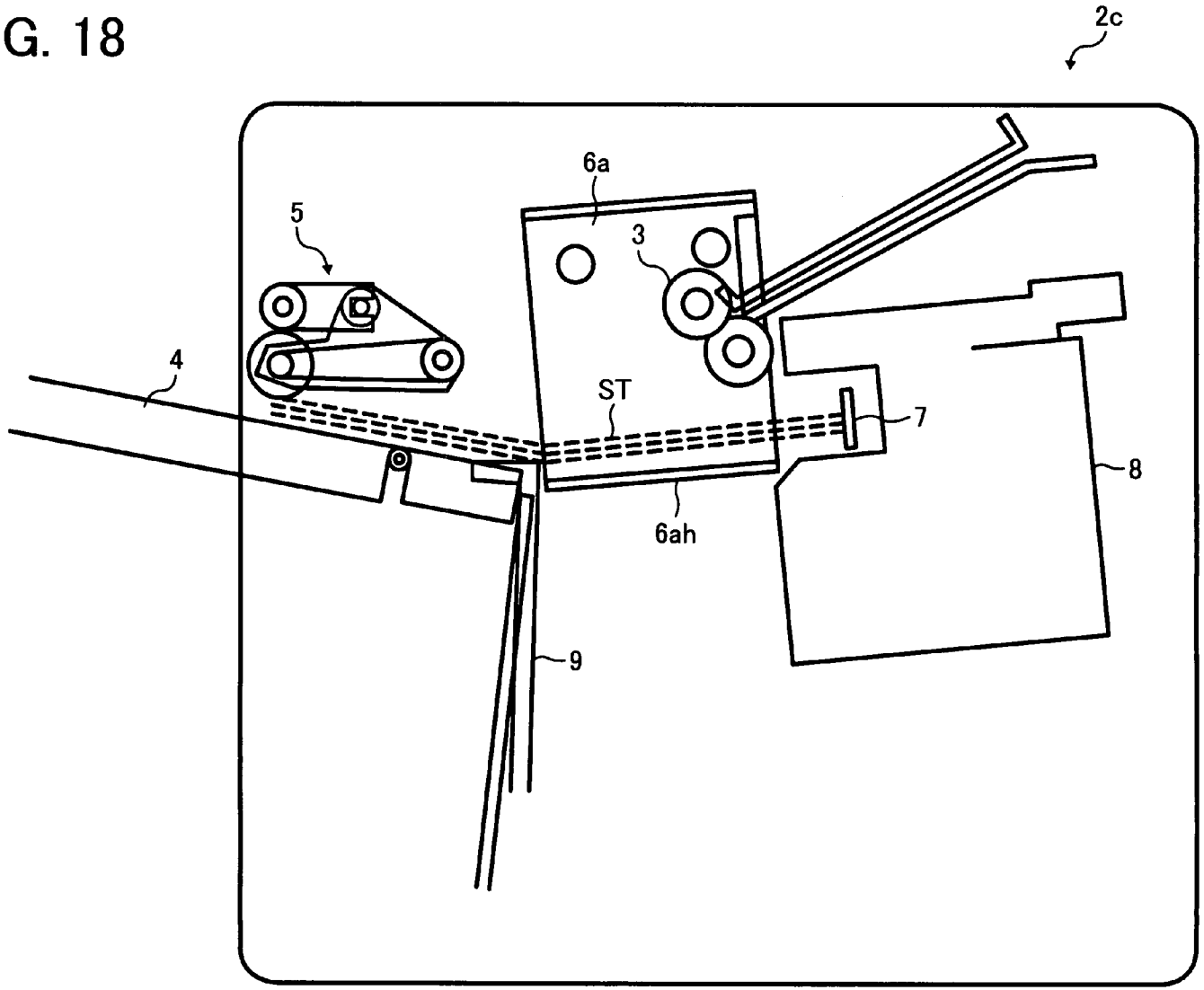
FIG. 18 is an example schematic diagram illustration an action of the sheet processing unit of FIG. 17.

FIG. 17 and 18 illustrate a sheet processing unit 2*c* according to example embodiments. The sheet processing unit 2*c* may be configured so that a sheet member is loaded in a curved manner, similar to the sheet processing unit 2*b*. The sheet processing unit 2*c* may include a jogger 6*a* that may be provided with a loading part 6*ah* on which the sheet is loaded in a curved manner. Other than that, each part of the sheet processing unit 2*c* has a similar configuration and a similar function to each part of the sheet processing unit 2. FIG. 17 illustrates an inclination angle γ of the jogger 6*a* and an inclination angle β of a loading surface of an ejection tray 4 with respect to a horizontal line H.

When a back-end fence 7 side of the loading part 6*ah* is at a higher position than a position of its opposite side, a relation between the inclination angles β and γ need not be specified. When the back-end fence 7 side of the loading part 6*ah* is at a lower position than the position of its opposite side, γ is not equal to β. More specifically, the loading part 6*ah* of the jogger 6*a* and loading surface of the tray 4 are not on a same plane. Therefore, a plurality of sheets ST may be curved in a sheet transfer direction shown as an arrow A.

According to example embodiments of FIGS. 17 and 18, a sheet member may be curved in whole, instead of being partially curved at a rear portion. As a result, a curled side of the sheet member may be widely corrected, and the sheet member may be more reliably transferred by an aligning mechanism, for example a jogger.

Figure 19:
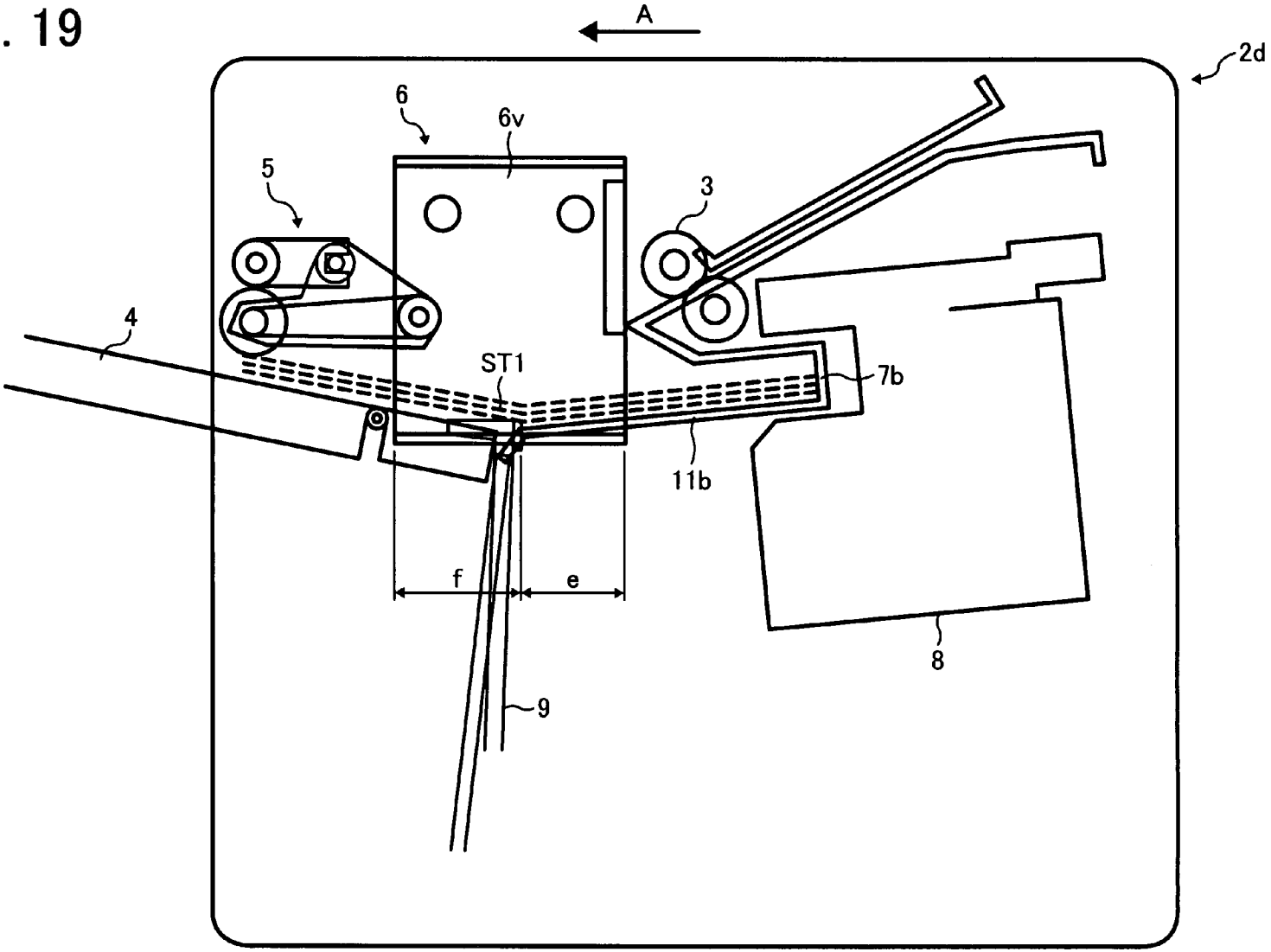
FIG. 19 is a schematic diagram of a sheet processing unit according to example embodiments.

FIG. 19 illustrates a sheet processing unit 2*d* according to example embodiments. The sheet processing unit 2*d* may include the back-end fence 7*b* that may be provided with the loading part 11*b* similar to the sheet processing units 2*a* and 2*b*. Similar to the sheet processing unit 2*b* of FIGS. 15 and 16, the sheet processing unit 2*d* may be configured to align a bundle of sheets that may be placed on the loading part 11*b* of the back-end fence 7*b* in a curved manner. The bundle of sheets may be curved in a sheet transfer direction shown as an arrow A. The bundle of sheets has its curved apex ST1 in a width of the vertical part 6*v* of the jogger 6. Other than that each part of the sheet processing unit 2*d* has a similar configuration and a similar function to each part of the sheet processing unit 2*b*. The width of jogger 6 may be divided by the curved apex ST1 into a distance e that is from the ST1 to an edge at an upstream side in the arrow A and another distance f that is from the ST1 to the other edge of the jogger 6. That is, e may be more than 0, and f may be more than 0.

According to example embodiments of FIG. 19, an aligning mechanism, for example a jogger, may more reliably align the bundle of sheet members by abutting against a curved portion of the sheet member. As a result, alignment of the sheet member may be improved.

Figure 20:
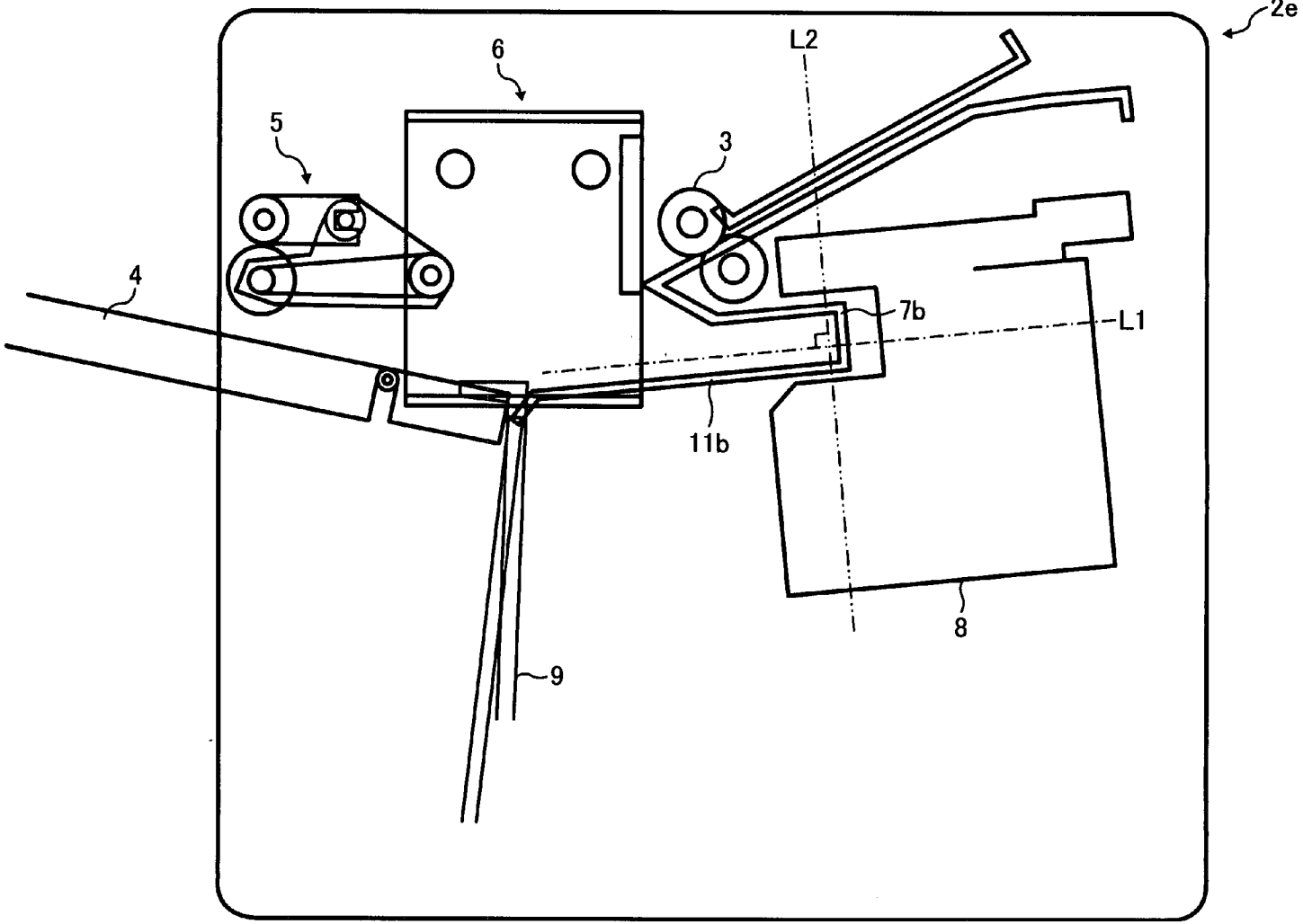
FIG. 20 is a schematic diagram of a sheet processing unit according to example embodiments.

FIG. 20 illustrates a sheet processing unit 2*e* according to example embodiments. The sheet processing unit 2*e* may include the back-end fence 7*b* that may be provided with the loading part 11*b* similar to the sheet processing units 2*a* and 2*b*. In the sheet processing unit 2*e*, the stapler 8 may be provided so that a piercing direction of the stapler 8 shown as a line L2 may be sub-vertical to a surface level of the loading part 11*b* shown as a line L2. Other than that each part of the sheet processing unit 2*e* has a similar configuration and a similar function to each part of the sheet processing unit 2*a* and 2*b*.

According to example embodiments of FIG. 20, a stitching member may sub-vertically inserts a staple into a bundle of sheet members. As a result, a failure in stapling, for example, buckling of a staple and the like may be prevented.

Figure 21:
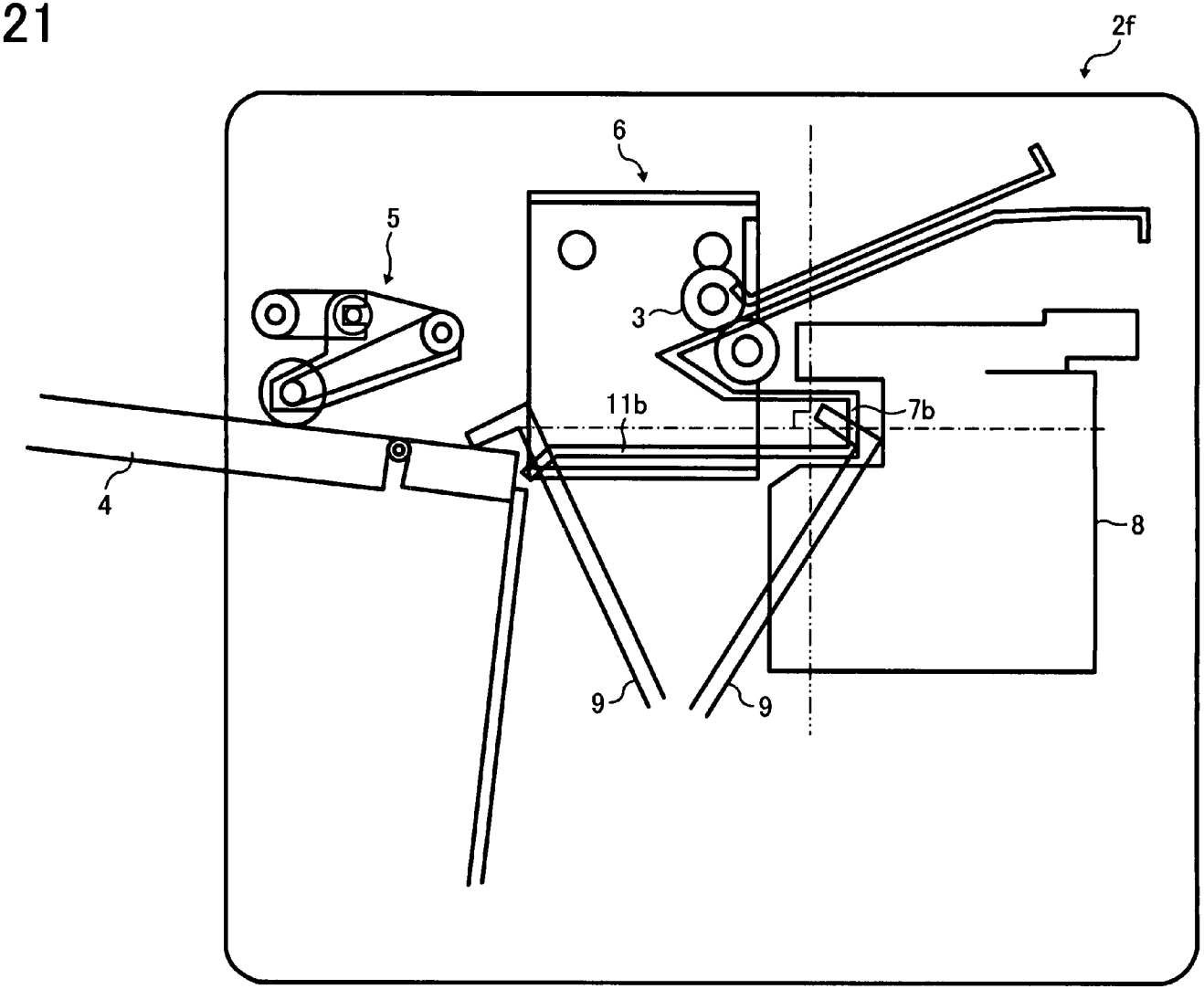
FIG. 21 is a schematic diagram of a sheet processing unit according to example embodiments.
Figure 22:
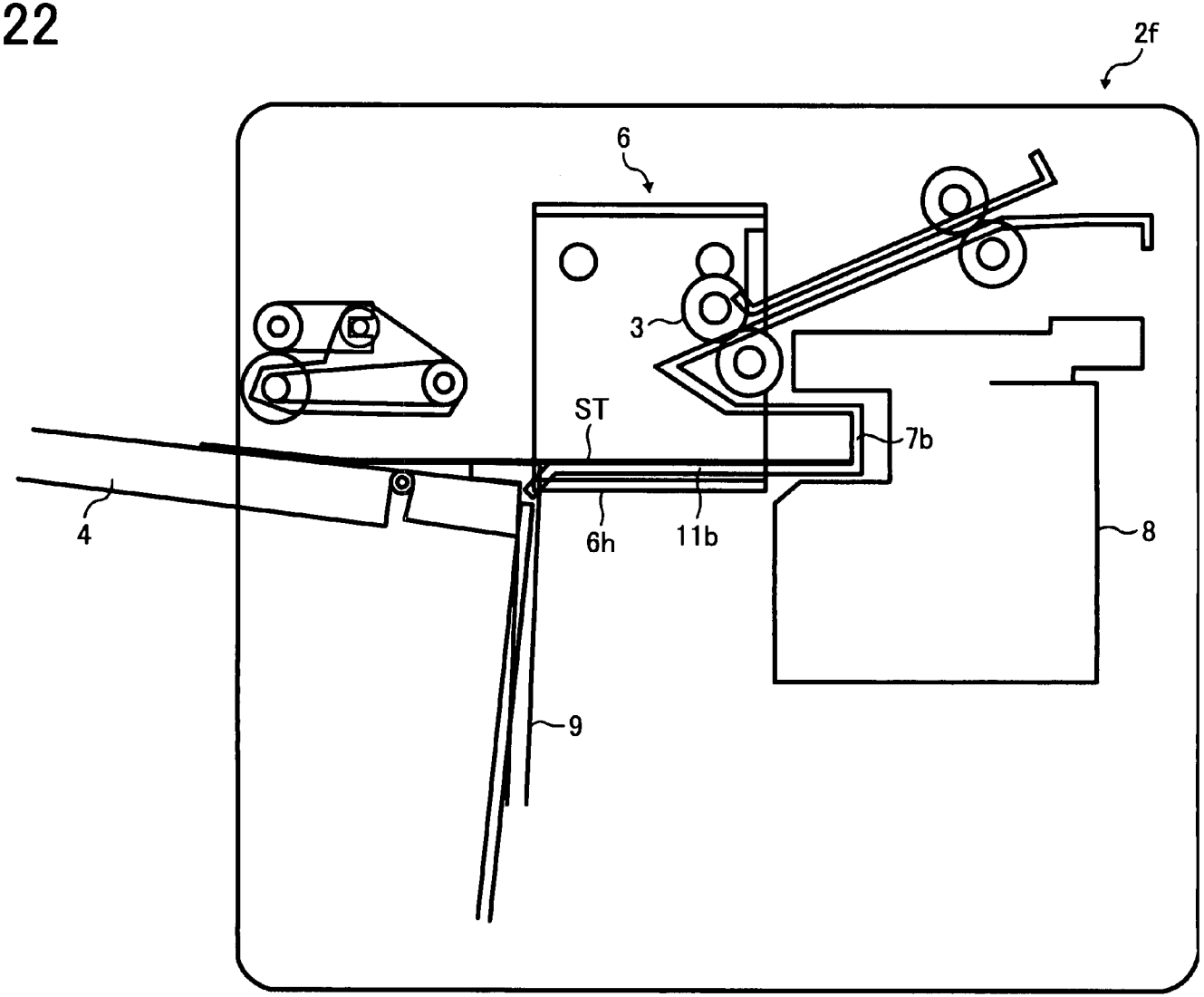
FIG. 22 is an example schematic diagram illustrating an action of a sheet processing unit of FIG. 21.

FIGS. 21 and 22 illustrate a sheet processing unit 2*f* according to example embodiments. The sheet processing unit 2*f* has a similar configuration to a configuration of the sheet processing unit 2*e* of FIG. 20. As illustrated in FIG. 21, in the sheet processing unit 2*f*, the loading part 11*b* of the back-end fence 7*b* may be near-horizontally provided. FIG. 22 illustrates a state that a back-end of a plurality of sheets ST abuts against the back-end fence 7*b* so that the plurality of sheets ST may be aligned, and the return roller 5 returns to the evacuation position. As illustrated in FIG. 22, the sheet ST may be near-horizontally loaded. Therefore, the stapler 8 may sub-vertically insert a staple into the plurality of sheets ST. In example embodiments, an inclination angle (not shown) of a loading part 6*h* of the jogger 6 may be equal to, or more than 0 and less than an inclination angle of an ejection tray 4 (not shown).

According to example embodiments of FIGS. 21 and 22, a back end of sheet members that is a part to be stitched may be aligned perpendicularly to a stitching angle of a stitching member, and the bundle of sheet members may be stitched in a perpendicularly aligned manner. As a result, improved alignment may be obtained.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JP2005-268972 filed on Sep. 15, 2005 and No. JP2006-218853 filed on Aug. 10, 2006 in the Japan Patent Office, the entire contents of each of which are incorporated by reference herein.

What is claimed is:

1. A sheet processing unit, comprising:

a sheet aligning unit including a sheet aligning mechanism configured to align a sheet member transferred into the sheet aligning unit, the sheet aligning mechanism including a sheet stopper configured to align the sheet member at a trailing edge thereof;

an ejection sheet tray configured to stack the sheet member;

a return mechanism configured to return the sheet member stacked on the ejection sheet tray to the sheet stopper;

a discharging mechanism configured to discharge the sheet member, aligned by the return mechanism, from the sheet stopper to the ejection sheet tray;

a first jogger with a first vertical part and a first movable loading part, the first vertical part configured to contact a first edge of the sheet member and the first movable loading part configured to stack the sheet member;

a second jogger with a second vertical part and a second movable loading part, the second vertical part configured to contact a second edge of the sheet member and the second movable loading part configured to stack the sheet member; and a guide bar passing through the first vertical part and the second vertical part, wherein the return mechanism faces a loading surface of the ejection sheet tray and the return mechanism includes a structure configured to press against the ejection sheet tray.

2. The sheet processing unit according to claim 1, wherein the sheet aligning mechanism aligns the sheet member in a direction along a surface plane of the sheet member and perpendicular to a direction in which the sheet member is transferred.

3. The sheet processing unit according to claim 1, further comprising:

a stitching mechanism configured to stitch a bundle of sheets aligned by the sheet aligning mechanism.

4. The sheet processing unit according to claim 1, wherein the sheet stopper includes a support part for supporting the sheet member.

5. The sheet processing unit according to claim 3, wherein the sheet stopper includes a support part for supporting the sheet member.

6. The sheet processing unit according to claim 4, wherein the support part of the sheet stopper and the loading surface of the ejection sheet tray are not on a same plane.

7. The sheet processing unit according to claim 1, wherein the loading parts of the sheet aligning mechanism and the loading surface of the ejection sheet tray are not on a same plane.

8. The sheet processing unit according to claim 4, wherein the sheet aligning mechanism contacts a side surface of a curved part of the sheet member lying over the support part of the sheet stopper and the loading surface of the ejection sheet tray for aligning the sheet member.

9. The sheet processing unit according to claim 5, wherein the stitching mechanism stitches sheet members substantially vertically to the sheet support part of the sheet stopper.

10. The sheet processing unit according to claim 1, wherein the loading parts of the sheet aligning mechanism and a sheet support part of the sheet stopper are substantially horizontally arranged.

11. An image forming apparatus, comprising:

an image forming mechanism configured to form an image and transfer the image onto a sheet member; and the sheet processing unit of claim 1.

12. The sheet processing unit according to claim 1, wherein the structure is a roller.

13. The sheet processing unit according to claim 1, wherein the ejection sheet tray provides support for the sheet member during the alignment operation by the sheet aligning unit.

14. A sheet processing unit, comprising:

a sheet aligning mechanism including a loading part configured to stack a sheet member transferred into the sheet aligning mechanism and a vertical part configured to act on an edge surface of the sheet member;

an ejection sheet tray configured to stack the sheet member;

a sheet stopper configured to align the sheet member at a trailing edge thereof;

a return mechanism configured to return the sheet member stacked on the ejection sheet tray to the sheet stopper; and a discharging mechanism configured to discharge the sheet member, aligned by the return mechanism, from the sheet stopper to the ejection sheet tray, wherein the return mechanism faces the ejection sheet tray and the return mechanism is further configured to exert a force against the ejection sheet tray to generate a friction force between the return mechanism and the paper, the friction force being used to return the sheet member to the sheet stopper.

15. A sheet processing unit, comprising:

a sheet aligning unit, the sheet aligning unit including a sheet aligning mechanism configured to align a sheet member transferred into the sheet aligning unit, the sheet aligning mechanism including a first jogger with a first vertical part and a first movable loading part, the first vertical part configured to contact a first edge of the sheet member and the first movable loading part configured to stack the sheet member, a second jogger with a second vertical part and a second movable loading part, the second vertical part configured to contact a second edge of the sheet member and the second movable loading part configured to stack the sheet member, a sheet stopper configured to align the sheet member at a trailing edge thereof, and a guide bar passing through the first vertical part and the second vertical part;

an ejection sheet tray configured to stack the sheet member;

a return mechanism configured to return the sheet member stacked on the ejection sheet tray to the sheet stopper; and a discharging mechanism configured to discharge the sheet member, aligned by the return mechanism, from the sheet stopper to the ejection sheet tray, wherein the return mechanism faces the sheet ejection tray and the return mechanism is further configured to exert a force against the ejection sheet tray to generate a friction force between the return mechanism and the paper, the friction force being used to return the sheet member to the sheet stopper.

* * * * *